US011712600B2

(12) United States Patent
Kim

(10) Patent No.: US 11,712,600 B2
(45) Date of Patent: Aug. 1, 2023

(54) CONVERTIBLE BICYCLE EXERCISE APPARATUS

(71) Applicant: Dong Soo Kim, Osan-si (KR)

(72) Inventor: Dong Soo Kim, Osan-si (KR)

( * ) Notice: Subject to any disclaimer, the term of this patent is extended or adjusted under 35 U.S.C. 154(b) by 202 days.

(21) Appl. No.: 17/435,423

(22) PCT Filed: Jan. 13, 2021

(86) PCT No.: PCT/KR2021/000482
§ 371 (c)(1),
(2) Date: Sep. 1, 2021

(87) PCT Pub. No.: WO2021/246604
PCT Pub. Date: Dec. 9, 2021

(65) Prior Publication Data

US 2022/0314063 A1 Oct. 6, 2022

(30) Foreign Application Priority Data

Jun. 3, 2020 (KR) ..... 10-2020-0066921

(51) Int. Cl.
*A63B 22/06* (2006.01)
*A63B 21/00* (2006.01)

(52) U.S. Cl.
CPC ..... *A63B 22/0605* (2013.01); *A63B 21/4034* (2015.10); *A63B 2022/0641* (2013.01); *A63B 2208/0228* (2013.01); *A63B 2225/09* (2013.01)

(58) Field of Classification Search
CPC ..... A63B 22/0605; A63B 23/0476; A63B 2022/0623; A63B 21/00181;
(Continued)

(56) References Cited

U.S. PATENT DOCUMENTS 3,759,511 A * 9/1973 Zin ..... A63B 21/015 482/142
4,900,014 A * 2/1990 DeGraff ..... A63B 22/0605 482/904

(Continued)

FOREIGN PATENT DOCUMENTS

CN 104324480 A 2/2015
CN 109955972 A 7/2019

(Continued)

*Primary Examiner* — Andrew S Lo
*Assistant Examiner* — Andrew M Kobylarz
(74) *Attorney, Agent, or Firm* — Korus Patent, LLC; Seong Il Jeong

(57) ABSTRACT

The present invention is directed to a multiply convertible bicycle exercise apparatus, and intends to provide a multiply convertible bicycle exercise apparatus that allows the form of a bicycle exercise apparatus to be freely converted into various forms such as standing, sitting, dancing, and riding forms, so that various types of exercise can be enjoyed, various types of exercise apparatuses can be replaced with a single exercise apparatus, and the shape and size of the exercise apparatus can be adjusted to fit the physical size of a user even in a converted state, and that changes the location of the center of gravity of the bicycle exercise apparatus from the existing lower portion to the upper portion where a user's groin is located, so that the bicycle exercise apparatus is stable in connection with the center of gravity and is superior in terms of stability.

8 Claims, 12 Drawing Sheets

(58) Field of Classification Search
CPC ..... A63B 71/0622; A63B 21/4034; A63B 2209/00; A63B 2210/50; A63B 2208/022; A63B 2225/09; A63B 2022/0635; A61H 1/0237; A61H 2201/0192; A61H 2205/12; A61H 2201/164; A61H 2201/0157; A61H 2205/06; A61H 2205/065; A61H 2205/10; A61H 2201/1671; A61H 1/00; B62M 9/134; B62M 9/1246
See application file for complete search history.

(56) References Cited

U.S. PATENT DOCUMENTS

| | | | | |
|---|---|---|---|---|
| 2004/0176218 | A1* | 9/2004 | Fan | A63B 22/0605 482/57 |
| 2020/0054919 | A1* | 2/2020 | Karabush | A63B 21/0428 |
| 2021/0275862 | A1* | 9/2021 | Kim | A63B 71/0054 |

FOREIGN PATENT DOCUMENTS

| | | | |
|---|---|---|---|
| KR | 10-2017-0052289 | A | 5/2017 |
| KR | 10-1783154 | B1 | 9/2017 |
| KR | 10-2150353 | B1 | 9/2020 |
| WO | 2017/032838 | A1 | 3/2017 |

* cited by examiner

CONVERTIBLE BICYCLE EXERCISE APPARATUS

TECHNICAL FIELD

The present invention relates to a bicycle exercise apparatus, and more particularly to a convertible bicycle exercise apparatus in which various types of exercise can be enjoyed because the form of the bicycle exercise apparatus can be changed into various forms, the shape and size of the bicycle exercise apparatus can be adjusted to fit a user's physical size even in a converted state, the bicycle exercise apparatus is stable in connection with the center of gravity thereof by changing the center of gravity of the bicycle exercise apparatus from a lower end to an upper end, the bicycle exercise apparatus is free to tilt and move in all directions, and the cycling effect of pedaling while sitting on a chair and a riding exercise effect and a buff bike exercise effect attributable to the elastic force of springs can be obtained together.

BACKGROUND ART

In general, cycling is the most economical and effective exercise method capable of maintaining and improving health and physical strength.

Cycling is an aerobic exercise that mainly uses large muscles of the lower body, and is an exercise that can develop a cardiorespiratory function and the muscle strength of the lower body, can improve a circulatory system function and muscular endurance, and is effective for people with weak lower body muscle strength, people with weak joints, people with osteoporosis, and people with obesity because it does not put strains on the joints.

In addition, cycling has the advantage of being able to do exercise without boredom because it runs a relatively long distance on various courses and terrains.

Recently, many bicycle exercise apparatuses that enable exercises to be done indoors by using bicycles are widely popularized. A general bicycle exercise apparatus gives an exercise effect to the thighs and the calves as a user steps on pedals, and allows the buttocks and the waist to shake from side to side as a user alternately steps on both pedals, so that a corresponding exercise effect and a weight reduction effect occur.

Such a bicycle exercise apparatus commonly includes a saddle configured such that a user can usually sit and exercise thereon, a bicycle body connected to the bottom of the saddle by saddle pipes, a base frame fixed to the lower side of the bicycle body and configured to support the bicycle body, a handle pipe attached to the upper portion of one side of the bicycle body at a predetermined angle and a handle fixed to the upper side of the handle pipe, and a pair of pedals installed on both sides of the center of the bicycle body.

The above-described bicycle exercise apparatus allows a user to do exercise in such a manner that the user sits on the saddle, grips the handle, puts his or her feet on the pedals, and then rotates the pedals by stepping on the pedals.

In this case, the bicycle exercise apparatus installed indoors has advantages in that a user can set the intensity of exercise by adjusting speed and resistance at the desired time regardless of the season and weather, so that a more accurate amount of exercise can be done than in the case of outdoor exercise. However, the bicycle exercise apparatus has disadvantages in that an exercise process is tedious because the bicycle exercise apparatus is configured to allow a user to do exercise by simply stepping on the pedals indoors and also in that dust is generated indoors during exercise and, at the same time, powder from the friction surfaces of bicycle wheels can have a bad effect on the respiratory system of the human body.

In addition, since the bicycle exercise apparatus is configured to allow a user to do cycling exercise by stepping on the pedals in a sitting state, partial exercise centered on the lower body is possible, but there is a problem in that there is a limitation in obtaining the effect of full-body exercise.

Furthermore, since the bicycle exercise apparatus is configured to be suitable for adults, there is a problem in that it is difficult for all family members including men and women of all ages to use it.

In addition, although the bicycle exercise apparatus has a considerable size and occupies a predetermined space indoors, it has no separate function other than a cycling exercise function, so that there is a problem in that the efficiency of the bicycle exercise apparatus is lower compared to the installation site thereof.

In order to solve the above-described problems, there was proposed a dancing- and riding-type bicycle exercise apparatus configured such that individual sides of the conventional bicycle exercise apparatus 10 were connected by spring members 11 and were tilted forward, backward, left and right within a predetermined range by the elastic force of the spring members.

However, in the case of the bicycle exercise apparatus, the center of gravity thereof is formed at the lower end of the bicycle exercise apparatus during exercise, and thus the weight is concentrated to the lower end during dancing-type exercise using the bicycle exercise apparatus 10. When the bicycle exercise apparatus 10 is inclined to one side due to the weight of the user, there is a safety-related problem such as the falling of the user Therefore, there is a demand for a bicycle exercise apparatus that has various exercise functions as well as a simple bicycle riding exercise function and can be safely used by a user.

(Patent document 1) Korean Patent No. 10-1564677
(Patent document 2) Korean Patent No. 10-0525807

DISCLOSURE

Technical Problem

The present invention has been conceived to overcome the above-described problems, and an object of the present invention is to provide a convertible bicycle exercise apparatus that allows the form of a bicycle exercise apparatus to be freely converted into various forms such as standing, sitting, dancing, and riding forms, so that various types of exercise can be enjoyed, various types of exercise apparatuses can be replaced with a single exercise apparatus, and the shape and size of the exercise apparatus can be adjusted to fit the physical size of a user even in a converted state.

In addition, an object of the present invention is to provide a convertible bicycle exercise apparatus that changes the location of the center of gravity of the bicycle exercise apparatus from the existing lower portion to the upper portion where a user's groin is located, so that the bicycle exercise apparatus is stable in connection with the center of gravity, is superior in terms of stability, thereby preventing a user of the exercise apparatus from being tilted in one direction and falling due to his or her weight, is free to tilt and move in all directions, and can achieve the cycling effect of pedaling while sitting on a chair installed in the state of being connected to a body part by springs and a horse riding effect and a buff bike exercise effect attributable to the elastic force of the springs.

In addition, the technical problems to be overcome by the present invention are not limited to the technical problems mentioned above, and other technical problems not mentioned are clearly understood by those of ordinary skill in the art to which the present invention pertains from the following description.

Technical Solution

In order to accomplish the above objects, the present invention provides a convertible bicycle exercise apparatus including: a body part formed as pipe-shaped frames each having a hollow therein, and including a pair of a first body and a second body each of which is formed as a pipe-shaped frame, each of which includes an upper horizontal member formed in a horizontal direction, a lower horizontal member formed to be spaced apart from the upper horizontal member by a predetermined distance in a vertical direction, and a vertical member formed in a vertical direction to connect one end of the upper horizontal member and one end of the lower horizontal member, each of which is formed in a sideways "U" shape, and in each of which a plurality of fastening holes are formed through both sides thereof at predetermined intervals, wherein the second body is disposed symmetrically to the first body; a support part configured to be provided under the body part and support the body part, formed as pipe-shaped frames each having a hollow therein, and including a support member which is formed in a bar shape, first and second auxiliary support members which are symmetrically inserted and installed into both ends of the support member, and each of which is formed in a "T" shape in which an auxiliary coupling piece is formed to protrude from the center thereof, and support rods which are formed to protrude upward at respective centers of the first and second auxiliary support members, wherein a plurality of fastening holes is formed through both sides of the support part at predetermined intervals; a saddle part including a saddle height adjustment member which is installed into any one of the vertical members of the body part and adjusts a height, a saddle movement member which has a pipe shape having movement holes so as to be movably installed in the saddle height adjustment member and in which installation holes are formed in both sides thereof, a seating member which is formed to allow a user to be seated thereon, and a saddle connection member which connects the saddle movement member and the seating member to each other; a handle part including a handle height adjustment member which is installed into any one of the vertical members of the body part and adjusts a height, a handle movement member which has a pipe shape having movement holes so as to be movably installed in the handle height adjustment member and in which installation holes are formed in both sides thereof, a grip member which is formed to allow a user to be seated thereon, and a handle connection member which connects the handle movement member and the grip member to each other; and a pedal part including a pedal movement member which is detachably installed onto the horizontal vertical member of the body part, in which a seating space is formed therein, and in which a plurality of installation holes is formed through both sides of the pedal movement member at predetermined intervals, a pedal member which is connected to the top surface of the pedal movement member and which is rotated by being stepped on by the user, and a driving unit; wherein the size of the fastening holes formed in the body part and the support part corresponds to the size of the installation holes formed in the saddle part, the handle part, the saddle movement member, the handle movement member, and the pedal movement member of the pedal part, the interval of the fastening holes formed in the body part and the support part corresponds to the interval of the installation holes formed in the pedal movement member of the pedal part, and the installation holes and the fastening holes are aligned with each other and fastening is performed by tightening fastening members thereinto.

In this case, a coupling piece is formed to protrude from an end of any one of the upper and lower horizontal members of the first body of the body part, a coupling piece is formed to protrude from an end of the remaining one of the lower and upper horizontal members of the second body, the coupling piece formed to protrude from the upper horizontal member or lower horizontal member of the first body is detachably inserted and coupled into the hollow of the upper horizontal member or lower horizontal member of the second body, and the coupling piece formed to protrude from the lower horizontal member or upper horizontal member of the second body is detachably inserted and coupled into the hollow of the lower horizontal member or upper horizontal member of the first body.

In addition, the support rods formed to protrude at the centers of the first and second auxiliary support members that are inserted into both ends of the support member of the support part are detachably inserted and installed into the hollows through openings formed at the lower ends of the respective vertical members formed in a direction vertical to the first and second bodies of the body part.

Furthermore, the saddle height adjustment member of the saddle part or the handle height adjustment member of the handle part is detachably inserted and installed into the hollow through an opening formed at the upper end of each vertical member formed in a direction vertical to the first and second bodies of the body part.

Preferably, connection rods are detachably inserted and installed onto the upper portions of the support rods formed to protrude from the top surfaces of the centers of the first and second auxiliary coupling members, each of the connection rods is formed as a pipe shape having a hollow therein, a slot-shaped movement hole is formed in the upper portion of one side of the connection rod, a fixing ring is provided in the lower portion of the movement hole, a movable spring member having elasticity in a vertical direction is provided inside the hollow of the connection rod, a coupling member having a coupling groove is provided to protrude on each of the upper portions of the outer surfaces of the vertical members of the first and second bodies of the body part, and a fixing ring is provided on the lower portion of the coupling member; movable rods are provided between the first and second bodies and the connection rods, one side of each of the movable rods is detachably inserted and coupled into the coupling groove of the coupling member formed on the upper portion of the outer surface of each vertical member, the remaining side of the movable rod is inserted and installed into the hollow through the movement hole formed in the upper portion of the connection rod and is connected to the upper end of the movable spring member, connection spring members each having ring members formed at one and other ends thereof are provided between the first and second bodies and the connection rods, one side ring member of the connection spring members is coupled to the fixing ring formed on the lower portion of the outer surface of each vertical member, and the remaining ring member thereof is coupled to the fixing ring provided on the lower portion of each of the connection rods; and, when the body part is selectively raised and lowered vertically, the movable rods connected to the coupling members of the body part are selectively raised and lowered vertically by the elasticity of the movable spring members in response to the movement of the body part.

Alternatively, fixing rods are detachably inserted and installed onto the upper portions of the support rods formed to protrude from the top surfaces of the centers of the first and second auxiliary coupling members; the fixing rods are formed in the shape of a pipe having a hollow therein, a slot-shaped rotation hole is formed on one side of each of the fixing rods in a vertical direction, rotatable spring members having elasticity in vertical directions are provided inside the hollows, rotation covers are detachably installed onto upper portions of the fixing rods so as to be rotated at idle, the lower portions of the rotation covers are connected to the rotation spring members, and fixing rings are provided on the upper portions of the outer surfaces of the vertical members of the first and second bodies of the body part; fixing spring members having ring members formed on one and other ends thereof are provided between the first and second bodies and the fixing rods, the fixing spring members are connected to fixing rings having one side ring members formed on the upper portions of the outer surfaces of the vertical members, the remaining side ring members are connected to the rotation spring members by rotation members, the rotation members have connection holes formed through one and other sides thereof, and any one of the connection holes is connected to one of the ring members of the fixing spring members, and the remaining connection hole is connected to one of the rotation spring members; and the rotation members connected to the fixing spring members are selectively raised and lowered up and down along the rotation spring members formed in a spiral shape in response to the rotation of the rotation spring members attributable to the rotation of the rotation covers.

In this case, fixing members are detachably inserted and installed into both ends of the first and second auxiliary support members, respectively, auxiliary support rods are formed to protrude upward from the upper surfaces of first sides of the fixing members, and auxiliary fixing rods are detachably inserted and installed onto the upper portions of the auxiliary support rods; the auxiliary fixing rods are formed in the shape of a pipe having a hollow therein, slot-shaped auxiliary rotation holes are formed through first sides of the auxiliary rods in vertical directions, auxiliary rotation spring members having elasticity in the vertical directions are provided in inner hollows, auxiliary rotation covers are detachably installed onto the tops of the auxiliary fixing rods so as to be rotated at idle, the bottoms of the auxiliary rotation covers are connected to the auxiliary rotation spring members, and fixing rings are provided on the upper portions of both sides of vertical members of the first and second bodies of the body part; auxiliary fixing spring members in each of which ring members are formed at one and other ends thereof are provided between the first and second bodies and the auxiliary fixing rods, the auxiliary fixing spring members are connected to the fixing rings in each of which one side ring members are formed on both sides of upper portions of the vertical members, other side ring members are connected to the auxiliary rotation spring members of auxiliary fixing holes by auxiliary rotation members, the auxiliary rotation members are provided with auxiliary connection holes formed through one and other sides thereof, any one of the auxiliary connection holes is connected to one of the ring members of the auxiliary fixing spring members, and the remaining auxiliary connection hole is connected to one of the auxiliary rotation spring members; and the auxiliary rotation members connected to the auxiliary fixing spring members are selectively raised and lowered up and down along the auxiliary rotation spring members formed in a spiral shape in response to the rotation of the auxiliary rotation spring members attributable to the rotation of the auxiliary rotation covers.

Meanwhile, the body part further includes a footrest part; and the footrest part is formed in the shape of a pipe having a movement hole so as to be movably inserted and installed into the first and second bodies, and includes a footrest movement member configured such that a plurality of installation holes is formed through both side surfaces thereof at predetermined intervals and a footrest member connected to the footrest movement member and formed as a plate so that the feet of the user are located thereon.

Advantageous Effects

As described above, the present invention having the above-described configuration can achieve effects in that various exercises can be enjoyed using a single bicycle exercise apparatus, exercise apparatuses in various forms such as a standing form, a sitting form, a dancing form, and a riding form can be replaced with a single bicycle exercise apparatus, user satisfaction can be improved because excellent effects can be achieved compared to the purchase cost of the exercise apparatus, children and adults can enjoy exercise with one exercise apparatus after installation in a home because the shape and size thereof can be adjusted to fit a physical size, and the location of the center of gravity of the bicycle exercise apparatus is changed from a lower end to an upper end, i.e., a location at or near a user's groin, so the bicycle exercise apparatus is stable in connection with the center of gravity thereof and also superior in terms of stability, with the result that it is possible to achieve the effect of preventing the risk of falling due to the user's tilting and inclination in one direction attributable to his or her weight.

In addition, the present invention can achieve effects in that maintenance is simple and easy because only parts with faults or abnormalities can be replaced and a cycling exercise effect, a riding exercise effect, and a buff bike exercise effect can be obtained together, so that an exercise effect can be considerably increased by using the exercise apparatus while experiencing real situations, not only the exercise of part of the body but also the exercise of the full body can be done because a user of the bicycle exercise apparatus can have an exercise effect obtained by stepping on pedals and an exercise effect obtained by the movement of a chair, and The exercise effect is excellent compared to the amount of exercise and also a full-body aerobic exercise effect can be achieved.

MODE FOR INVENTION

Figure 1:
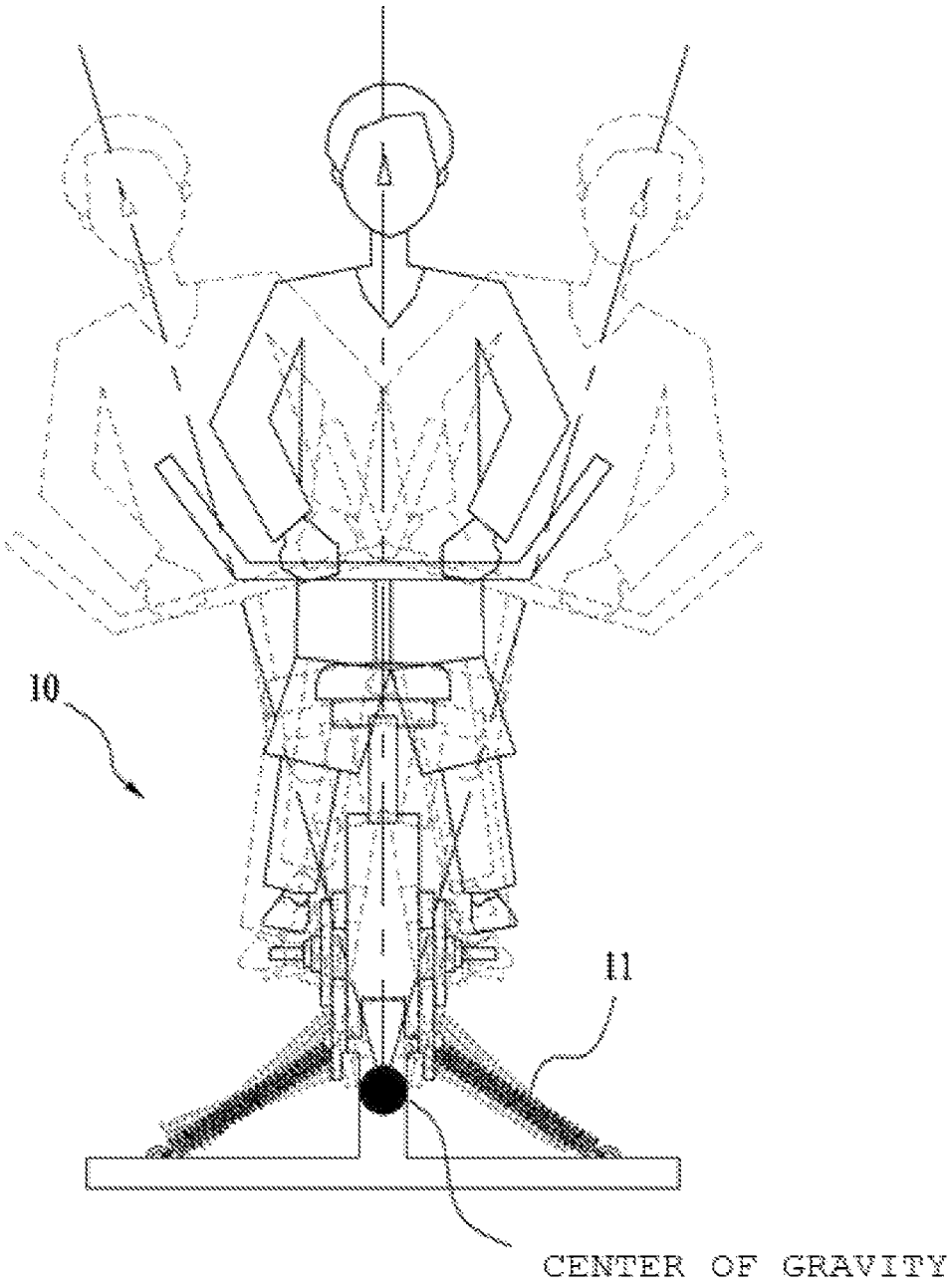
FIG. 1 is a view schematically showing the center of gravity during the operation of a conventional bicycle exercise apparatus.

Embodiments of the present invention will be described in detail below with reference to the accompanying drawings so that those skilled in the art can easily practice the present invention. However, the present invention may be embodied in various different forms and is not limited to the embodiments described herein. Furthermore, in order to clearly describe the present invention in the drawings, parts irrelevant to the description are omitted, and similar reference numerals are assigned to similar parts throughout the specification.

Throughout the specification, when a part is described as "being connected to" another part, this includes not only the case where they are "directly connected" to each other but also the case where they are "electrically connected" with a third element interposed therebetween. In addition, when a part is described as "including" an element, this means that one or more other components may be further included, rather than excluding one or more other components, unless otherwise stated. Furthermore, it should be understood that the above description does not preclude the possibility of the presence or addition of one or more other features, numbers, steps, operations, components, parts, or combinations thereof.

As used throughout the present specification, the terms of degree such as "approximately," "substantially," and the like are used to mean a corresponding value or a value close to the corresponding value when a unique manufacturing or material tolerance is presented, and are used to prevent unscrupulous infringers from the unfair use of the disclosure including an accurate or absolute figure presented to aid in the understanding of the present disclosure. As used throughout this specification, the term "step of" or "step of" does not mean "step for."

In the present specification, a "unit" includes a unit implemented by hardware, a unit implemented by software, and a unit implemented using both. Furthermore, one unit may be implemented using two or more pieces of hardware, and two or more units may be implemented by one piece of hardware.

In the present specification, part of the operation or function described as being performed by a terminal, apparatus, or device may be performed instead by a server connected to the terminal, apparatus, or device. In the same manner, part of the operation or function described as being performed by a server may also be performed by a terminal, apparatus, or device connected to the server.

In the present specification, part of the operation or function described as being mapped to or matched with a terminal may be interpreted as mapping or matching the terminal's unique number, which is the identification data of the terminal, or personal identification information.

In the present specification, the phrase "at least one" is defined as a term that can refer to a singular and a plural. In addition, although the term "at least one" may be used, it may be omitted, in which case the meaning thereof is the same as described above.

Figure 2:
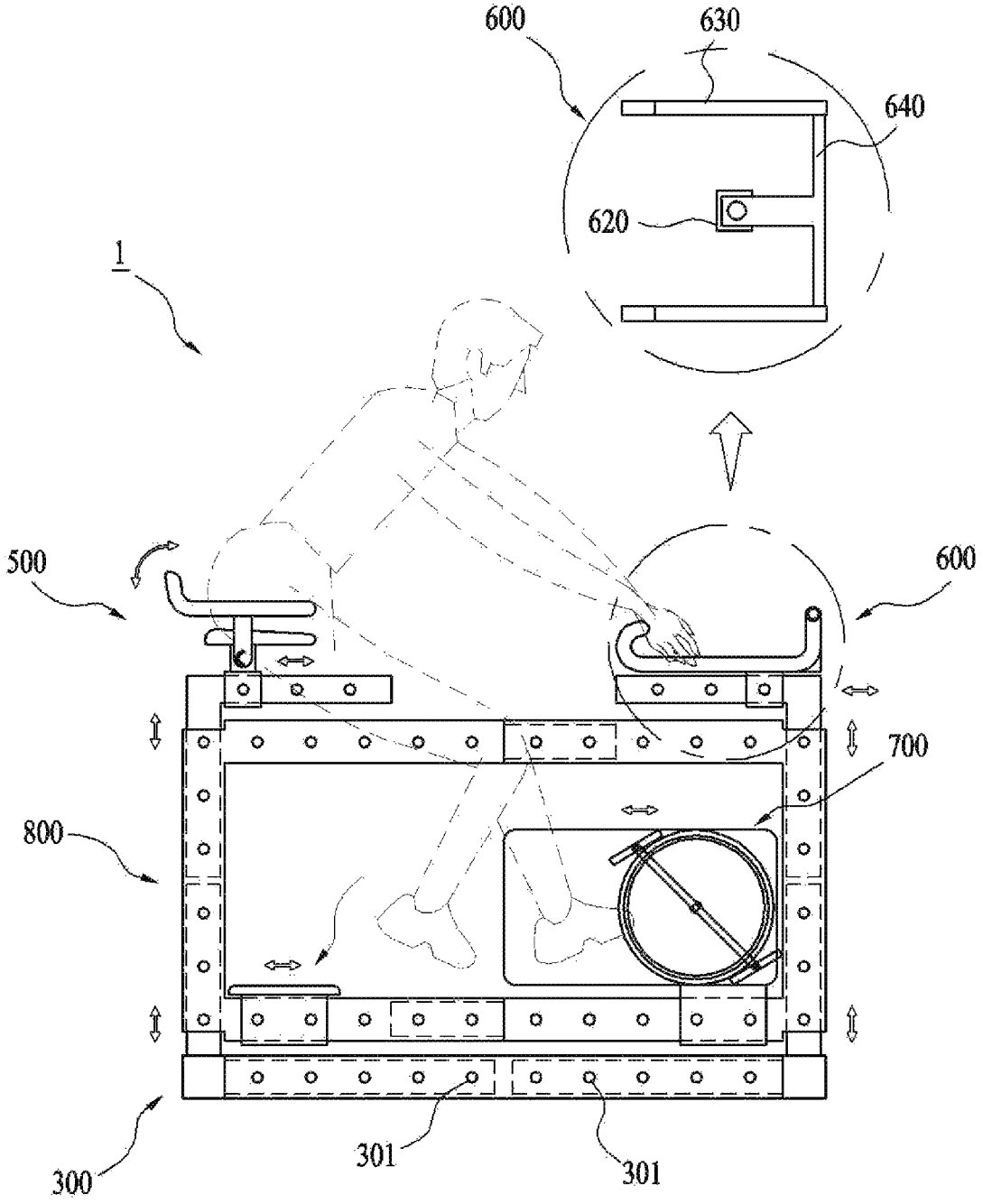
FIG. 2 is a side view schematically showing a first modification of a convertible bicycle exercise apparatus according to the present invention.
Figure 3:
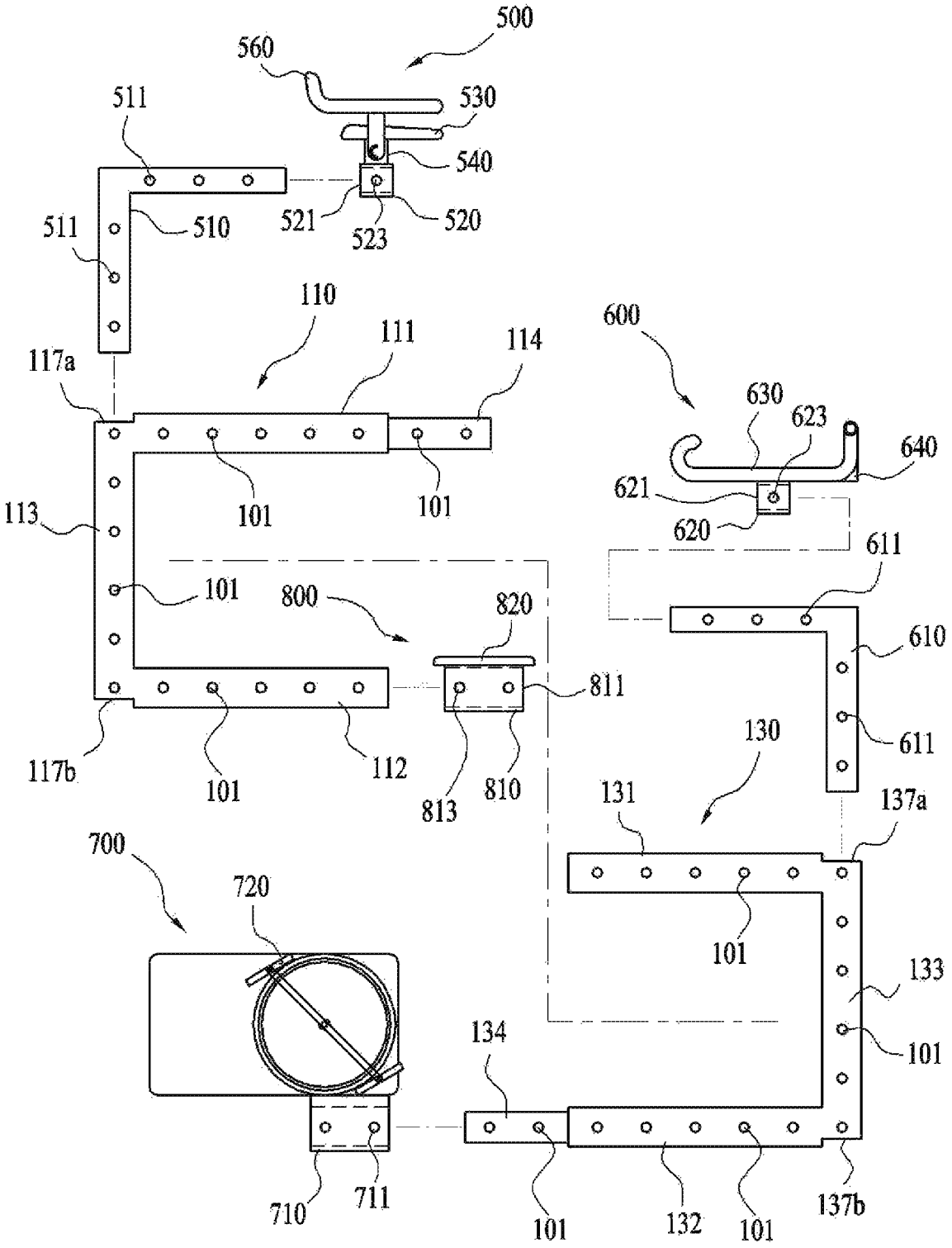
FIG. 3 is an exploded view schematically showing the body part, saddle part, handle part, pedal part, and footrest part of the first modification.
Figure 4:
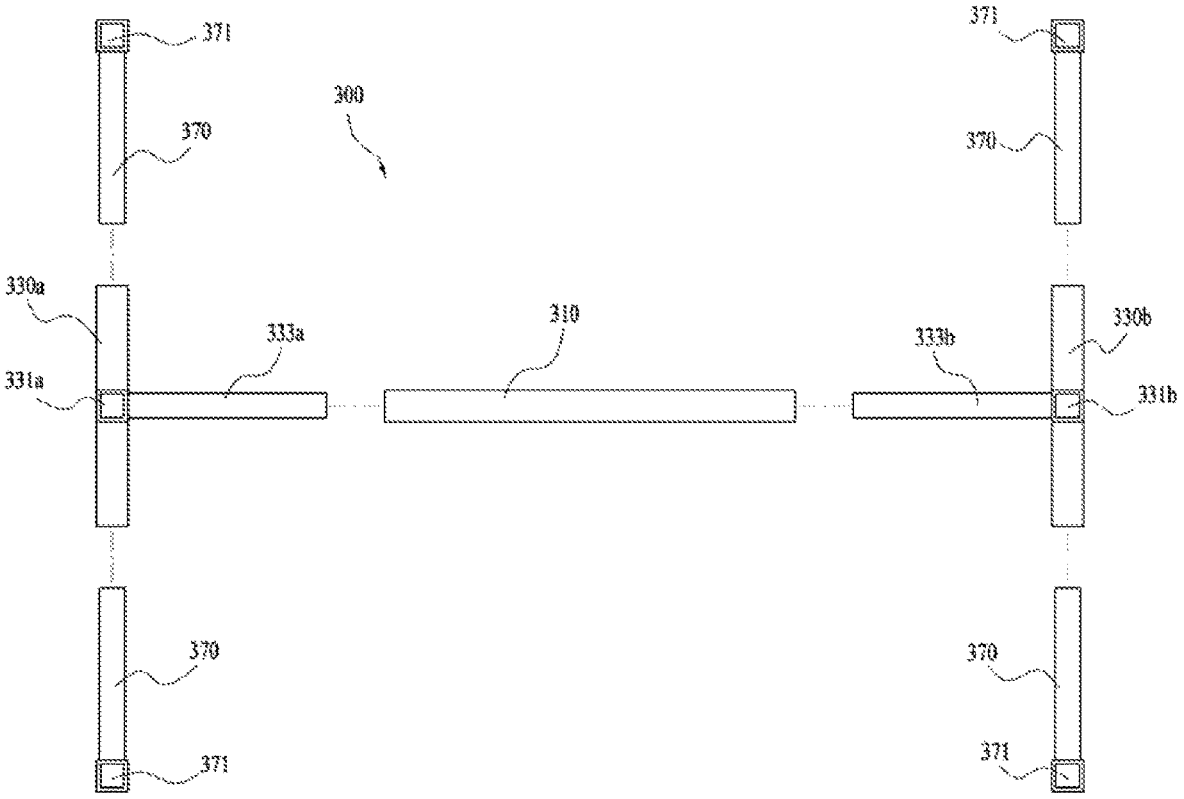
FIG. 4 is an exploded view schematically showing the support part of the first modification.
Figure 5:
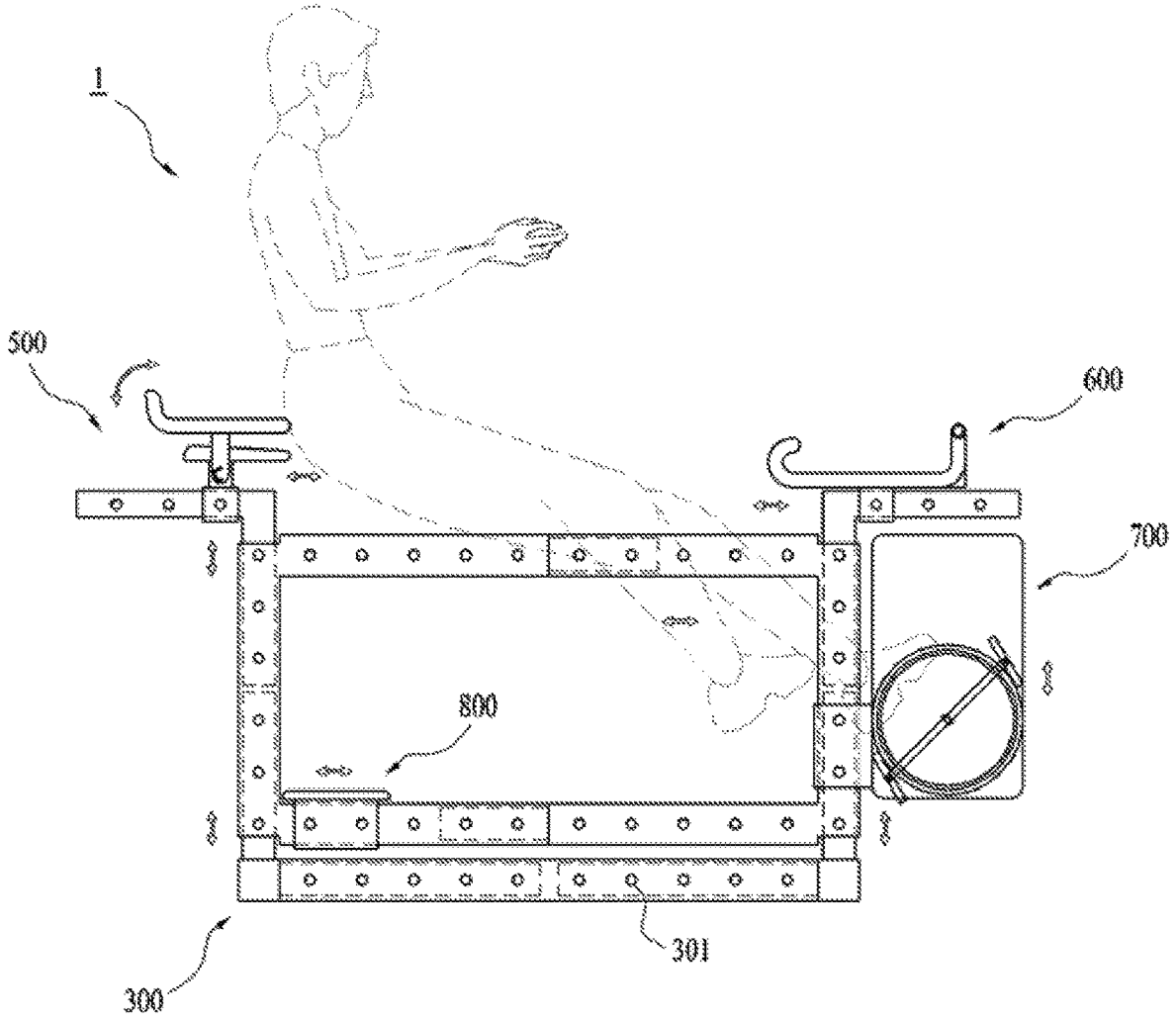
FIG. 5 is a side view schematically showing a second modification of a convertible bicycle exercise apparatus according to the present invention.
Figure 6:
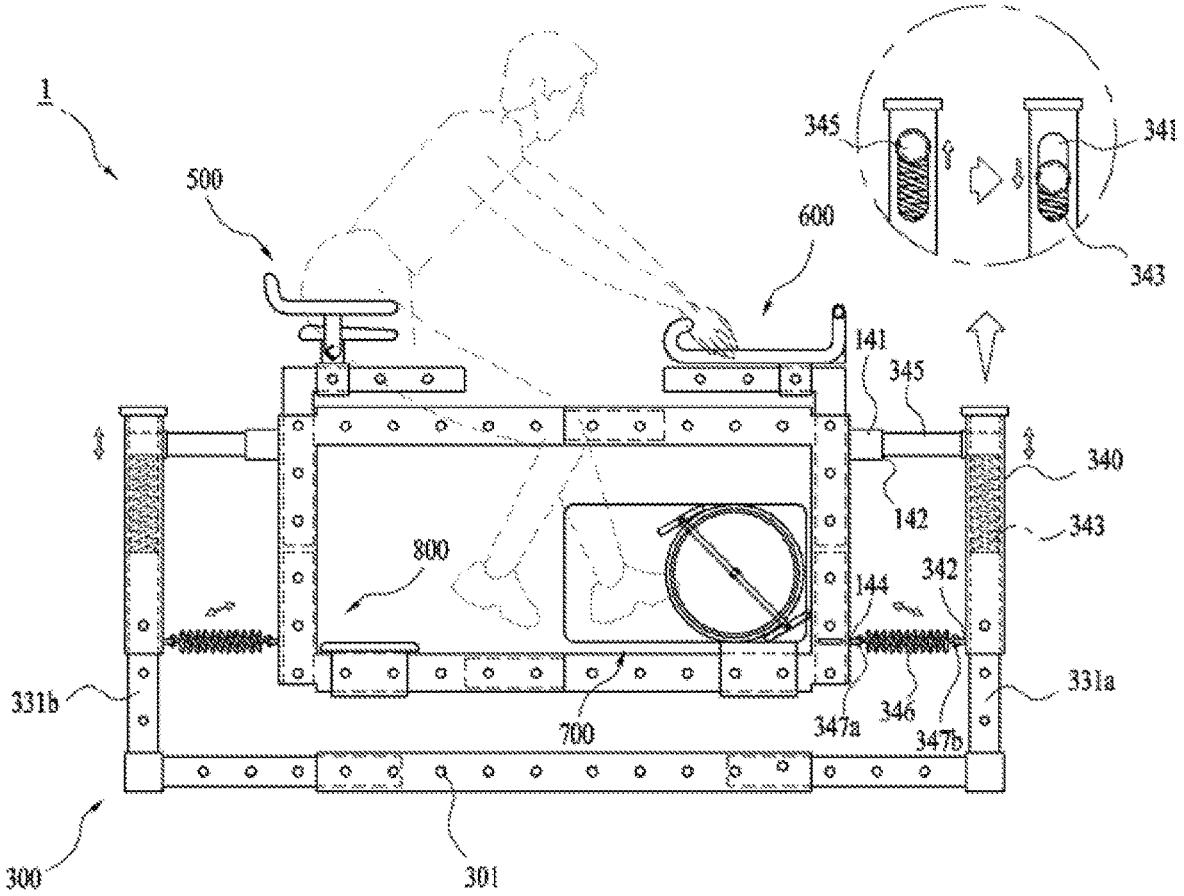
FIG. 6 is a side view schematically showing a third modification of a convertible bicycle exercise apparatus according to the present invention.
Figure 7:
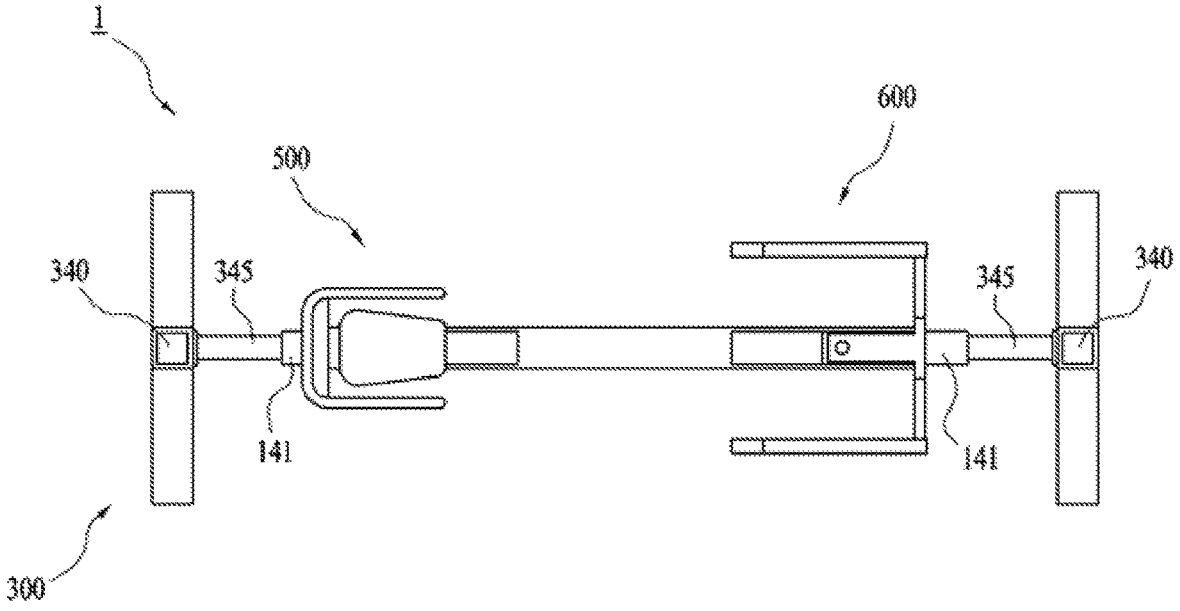
FIG. 7 is a plan view schematically showing a third modification.
Figure 8:
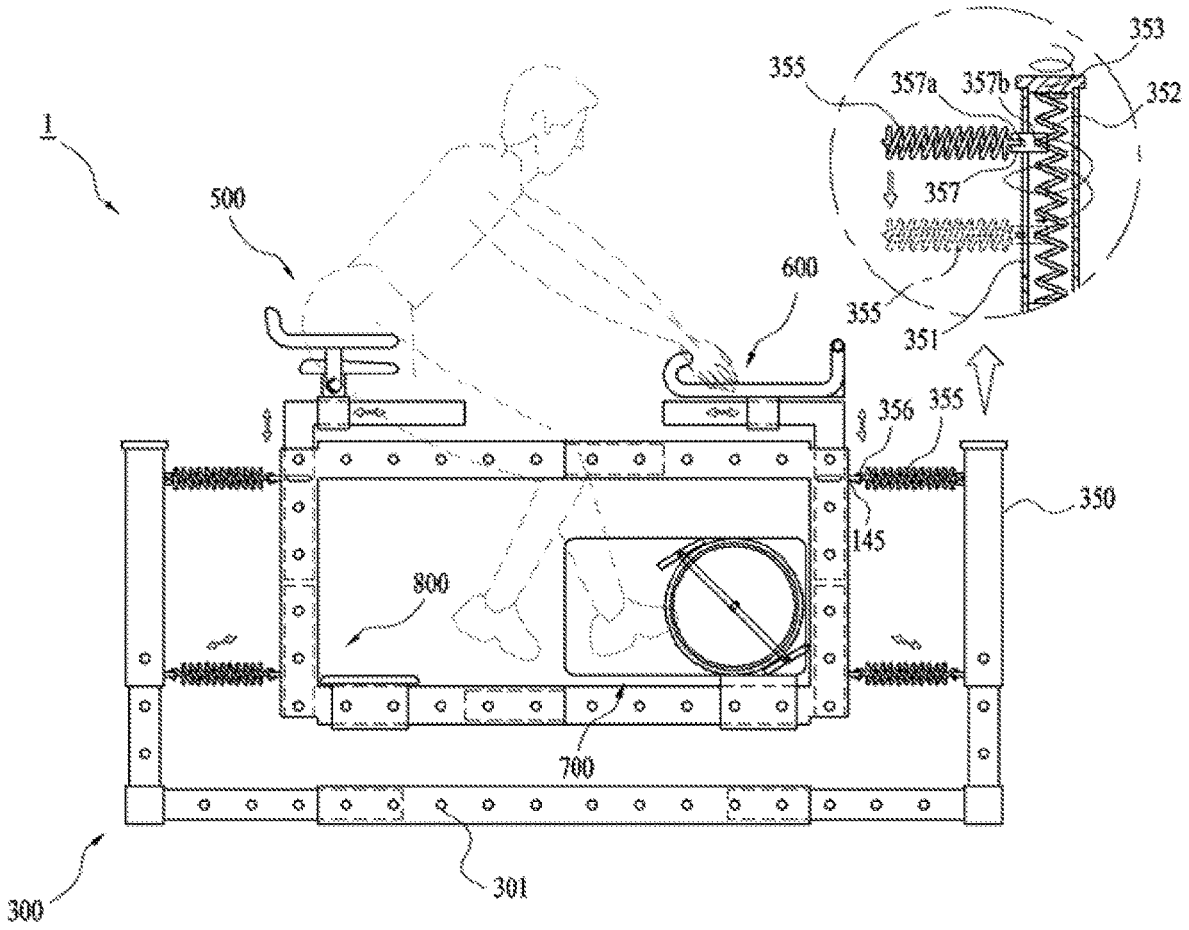
FIG. 8 is a side view schematically showing a fourth modification of a convertible bicycle exercise apparatus according to the present invention.
Figure 9:
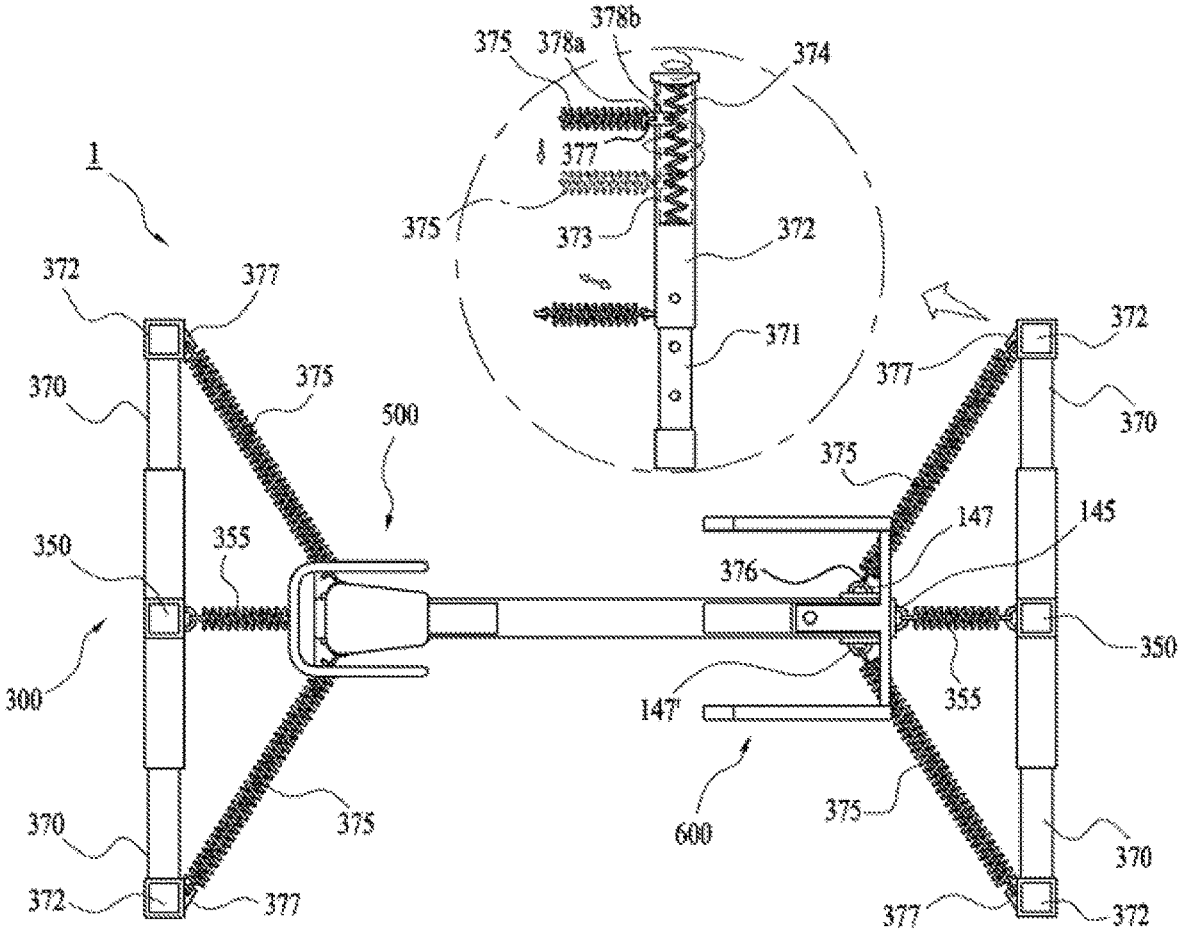
FIG. 9 is a plan view of the fourth modification.
Figure 10:
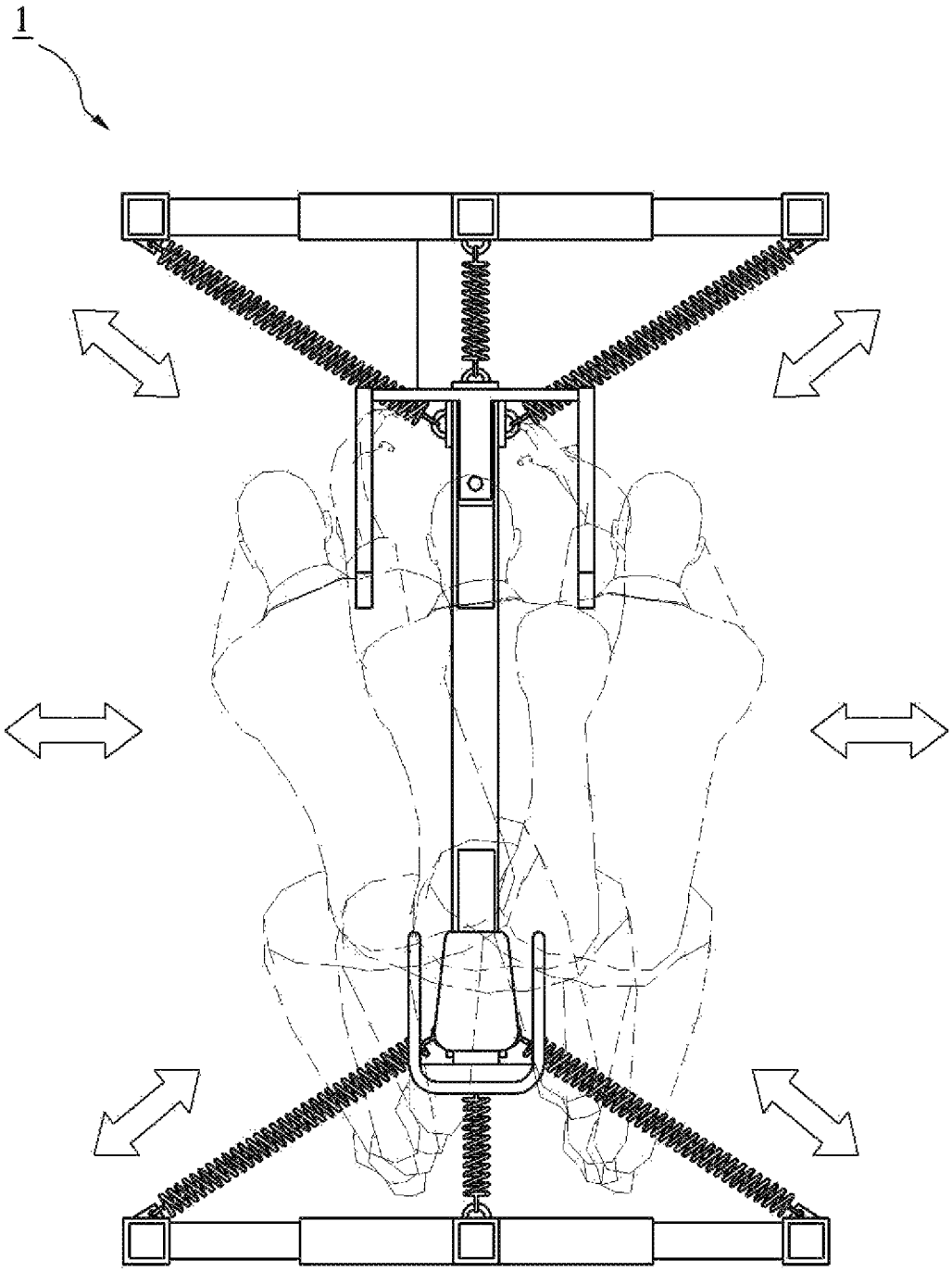
FIG. 10 is a diagram showing a state in which the bicycle exercise apparatus according to the fourth modification is used.
Figure 11:
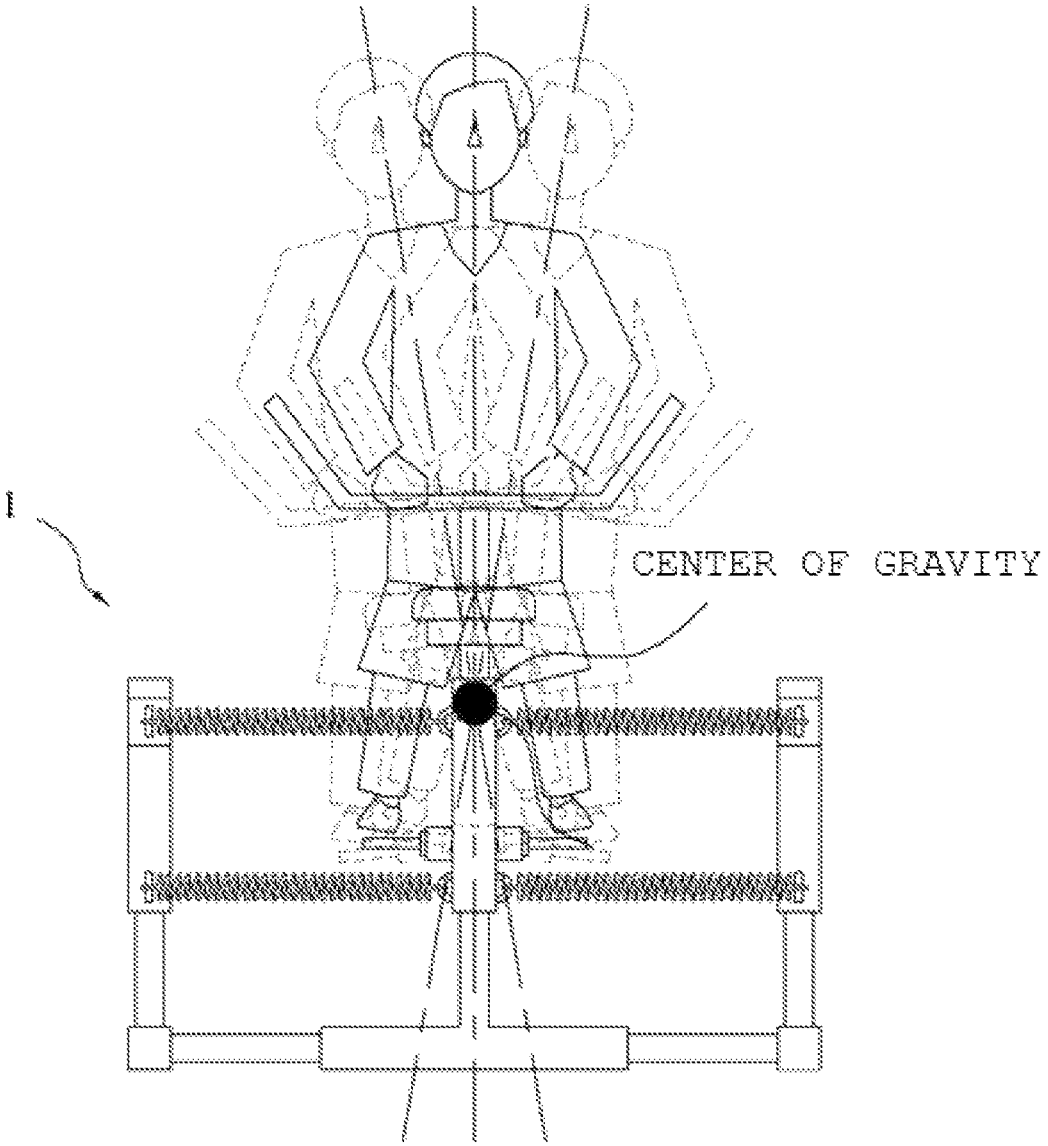
FIG. 11 is a view schematically showing the center of gravity during the operation of the convertible bicycle exercise apparatus according to the present invention.
Figure 12:
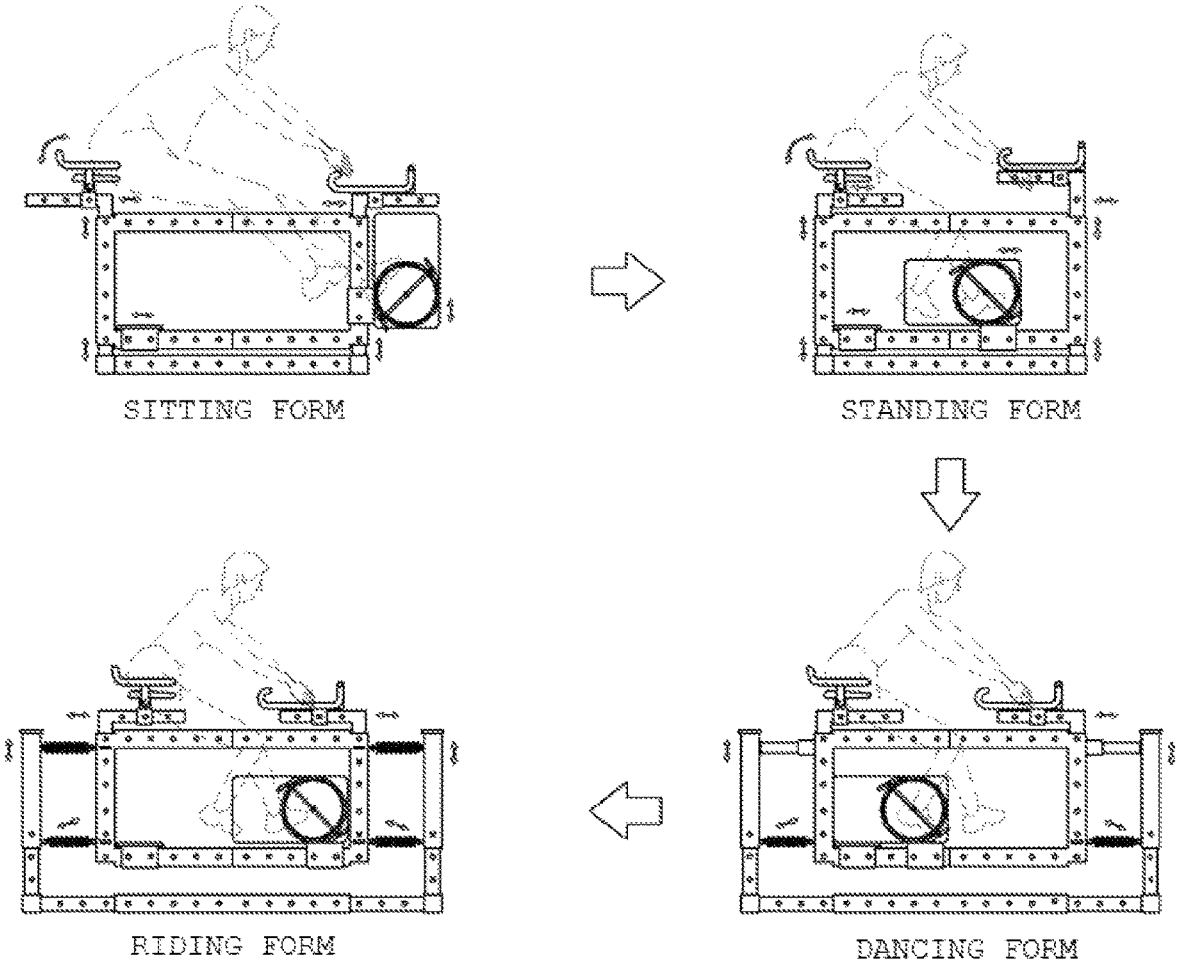
FIG. 12 is a flowchart schematically showing use embodiments in which the convertible bicycle exercise apparatus according to the present invention are converted into various forms.

Preferred embodiments of the present invention will be described below with reference to the accompanying drawings. FIG. 2 is a side view schematically showing a first modification of a convertible bicycle exercise apparatus according to the present invention, FIG. 3 is an exploded view schematically showing the body part, saddle part, handle part, pedal part, and footrest part of the first modification, FIG. 4 is an exploded view schematically showing the support part of the first modification, FIG. 5 is a side view schematically showing a second modification of a convertible bicycle exercise apparatus according to the present invention, FIG. 6 is a side view schematically showing a third modification of a multiply convertible bicycle exercise apparatus according to the present invention, FIG. 7 is a plan view schematically showing a third modification, FIG. 8 is a side view schematically showing a fourth modification of a convertible bicycle exercise apparatus according to the present invention, FIG. 9 is a plan view of the fourth modification, FIG. 10 is a diagram showing a state in which the bicycle exercise apparatus according to the fourth modification is used, FIG. 11 is a view schematically showing the center of gravity during the operation of the convertible bicycle exercise apparatus according to the present invention, and FIG. 12 is a flowchart schematically showing use embodiments in which the convertible bicycle exercise apparatus according to the present invention are converted into various forms.

As shown in the drawings, a convertible bicycle exercise apparatus 1 according to the present invention includes a body part 100, a support part 300, a saddle part 500, a handle part 600, and a pedal part 700.

The body part 100 is formed as pipe-shaped frames having a hollow (the reference numeral of which is not shown) therein, and includes a first body 110 and a second body 130 each of which includes an upper horizontal member 111 or 131 formed in the horizontal direction, a lower horizontal member 112 or 132 formed to be spaced apart from the upper horizontal member 111 or 131 by a predetermined distance in the vertical direction, and a vertical member 113 or 133 formed in the vertical direction to connect one end of the upper horizontal member 111 or 131 and one end of the lower horizontal member 112 or 132, and each of which is formed in an approximately sideways "U" shape.

In this case, the first body 110 and the second body 130 are disposed symmetrically to each other. A coupling piece 114 is formed to protrude from the end of any one of the upper horizontal member 111 and lower horizontal member 112 of the first body 110, and a coupling piece 134 is formed to protrude from the end of the opposite one of the lower horizontal member 132 and horizontal member 131 of the second body 130. In other words, the coupling piece 114 is formed to protrude from the end of any one of the upper horizontal member 111 and the lower horizontal member 112 of the first body 110, the second body 130 is disposed symmetrically to the first body 110, and the coupling piece 134 is formed to protrude from the end of the opposite one of the upper horizontal member 131 and the lower horizontal member 132 in the direction opposite to the coupling piece 114 formed in the first body 110.

By the above-described structure, the coupling piece 114 formed to protrude from the upper horizontal member 111 or lower horizontal member 112 of the first body 110 is detachably inserted and coupled into the hollow of the upper horizontal member 131 or lower horizontal member 132 of the second body 130, and the coupling piece 134 formed to protrude from the lower horizontal member 132 or upper horizontal member 131 of the second body 130 is detachably inserted and coupled into the hollow of the lower horizontal member 112 or upper horizontal member 111 of the first body 110.

As described above, the coupling pieces 114 and 134 formed to protrude from the upper horizontal member 111 or 131 or lower horizontal member 112 and 132 of the first body 110 or the second body 130 disposed symmetrically to the first body 110 are inserted and coupled into the hollows formed in the lower horizontal member 132 or 112 or upper horizontal member 131 or 111 of the second body 130 or the first body 110, and thus the body part 100 is formed to be coupled in a substantially "rectangular" shape.

In this case, the size of the coupling pieces 114 and 134 formed to protrude from the upper horizontal member 111 or 131 or lower horizontal member 112 or 132 of the first body 110 and the second body 130 is formed to correspond to the size of the hollows formed in the upper horizontal member 131 or 111) or lower horizontal member 132 or 112 of the first body 130 and the first body 110, and then the coupling pieces 114 and 134 are detachably inserted and coupled into the hollows.

In one embodiment of the present invention, the coupling piece 114 is formed to protrude from the upper horizontal member 111 of the first body 110 and is inserted and coupled into the hollow formed in the upper horizontal member 131 of the second body 130, the coupling piece 134 is formed to protrude from the lower horizontal member 132 of the second body 130 and is inserted and coupled into the hollow formed in the lower horizontal member 112 of the first body 110, and the first body 110 and the second body 130 are configured to be detachably coupled to each other. Alternatively, the coupling piece 114 may be formed to protrude from the lower horizontal member 112 of the first body 110 and be inserted and coupled into the hollow formed in the lower horizontal member 132 of the second body 130, and the coupling piece 134 may be formed to protrude from the upper horizontal member 131 of the first body 130 and may be inserted and coupled into the hollow formed in the upper horizontal member 111 of the first body 110, so that the first body 110 and the second body 130 may be configured to be detachably coupled to each other. Alternatively, the coupling piece 111 or 134 may be formed to protrude only from the upper or lower horizontal member 111, 131, 112, or 132 of any one of the first body 110 and the second body 130, and may be detachably inserted and coupled into the hollow formed in the upper or lower horizontal member 111, 131, 112, or 132 of the other body 130 or 110. The present invention is not limited thereto, and various modifications may be possible.

Meanwhile, fastening holes 101 for securing fastening members (not shown) are formed through both sides of the first body 110 and the second body 130 constituting the body part 100, and include a plurality of fastening holes 101 spaced apart at the same regular intervals. In other words, for the purpose of coupling and fixing when the convertible bicycle exercise apparatus 1 according to the present invention is installed, the plurality of fastening holes 101 is formed through both sides of the first body 110 and the second body 130 in order to fix coupling by securing fastening members such as bolts. The fastening holes 101 formed through both sides of the upper horizontal members 111 and 131, the lower horizontal members 112 and 132 and the vertical members 113 and 133 of the first body 110 and the second body 130 include a plurality of fastening holes that have the same size and are spaced apart at the same regular intervals.

In this case, the fastening holes 101 are formed through both sides of each of the coupling pieces 114 and 134 formed to protrude from the first body 110 and the second body 130. These fastening holes 101 also have the size and interval that correspond to the size and interval of the fastening holes 101 formed in the upper horizontal members 111 and 131, lower horizontal members 112 and 132 and vertical members 113 and 133 of the first body 110 and the second body 130.

In this way, the fastening holes 10 formed through the first body 110 and the second body 130 and the fastening holes 101 formed through the coupling pieces 114 and 134 are formed in the same size at the same interval. When the first body 110 and the second body 130 are coupled to each other, the fastening holes 101 of the coupling pieces 114 and 134 inserted into the hollows of the first body 110 and the second body 130 and the fastening holes 101 formed in the first body 110 and the second body 130 are arranged at the same positions, and fastening members such as bolts are fastened to the fastening holes 101, so that the coupling and installation of the body part 100 may be completed.

Meanwhile, openings 117*a*, 137*a*, 117*b*, and 137*b* are formed in the upper and lower ends of the vertical members 113 and 133 of the first body 110 and the second body 130. The size of the openings 117*a*, 137*a*, 117*b*, and 137*b* is formed to correspond to the size of the hollows.

The support part 300 includes a support member 310, first and second auxiliary support members 330*a* and 330*b* respectively inserted and installed into both ends of the support member 310, and support rods 331*a* and 331*b* formed to protrude upward from the centers of the first and second auxiliary support members 330*a* and 330*b*.

The support member 310 is a pipe-shaped frame having a hollow (the reference numeral of which is not shown) therein, and is formed in a bar shape.

The first and second auxiliary support members 330*a* and 330*b* are detachably inserted and installed into both ends of the support member 310. Each of the first and second auxiliary support members 330*a* and 330*b* is a pipe-shaped frame having a hollow therein, and is formed in a "T" shape in which an auxiliary coupling piece 333*b* is formed to protrude from the center thereof so that the auxiliary coupling piece 333*b* can be inserted into a corresponding one of the hollows of both ends of the support member 310.

In this case, the first auxiliary support member 330*a* and the second auxiliary support member 330*b* are disposed symmetrically at both ends of the support member 310, and the auxiliary coupling piece 333*b* formed at the center of each of the first and second auxiliary support members 330*a* and 330*b* is formed to have a size corresponding to the size of the hollow formed in the support member 310.

The support rods 331*a* and 331*b* are integrated with the respective centers of the first and second auxiliary support members 330*a* and 330*b*, and are formed to protrude upward.

In this case, the support rods 331*a* and 331*b* are detachably inserted and installed into the openings 117*b* and 137*b* formed in the lower ends of the vertical members 113 and 133 of the body part 100. To this end, the support rods 331*a* and 331*b* are formed to correspond to the sizes of the openings 117*b* and 137*b* and the hollows of the vertical members 113 and 133.

In this case, the support rods 331*a* and 331*b* are formed to protrude to a height allowing for being inserted and installed up to the centers of the members 113 and 133 when being installed in the hollows through the openings 117*b* and 137*b* formed at the lower ends of the respective vertical members 113 and 133 of the first and second bodies 110 and 130.

Meanwhile, in order to convert the convertible bicycle exercise apparatus 1 according to the present invention into a dancing form and then use it, connection rods 340 formed in the shape of a pipe having a hollow therein to be inserted and installed into the upper portion of the support rods 331*a* and 331*b* are further included. Each of the connection rods 340 has a slot-shaped movement hole 341 in the upper part of one side thereof, an annular fixing ring 342 is provided in the lower portion of the movement hole 341, and a movable spring member 343 having elasticity in the vertical direction is provided in the hollow inside of the annular fixing ring 342.

In addition, coupling members 141 having coupling grooves 142 in the upper portions of the outer surfaces of the vertical members 113 and 133 of the first and second bodies 110 and 130 of the body part 100 are provided to protrude in the horizontal direction, and annular fixing rings 144 are provided in the lower portions of the coupling members 141.

Meanwhile, movable rods 345 are provided between the coupling members 141 of the first and second bodies 110 and 130 and the movement holes 341 of the connection rods 340. One side of each of the movable rod 345 is inserted and coupled into the coupling groove 142 of the coupling member 141, and the other side thereof is inserted and installed into the hollow through the movement hole 341 of the connection rod 34 and is connected to the upper end of the movable spring member 343.

In this case, the movement hole 341 is formed in a slot shape elongated in the vertical direction on one side of the connection rod 340, and the size of the movable rod 345 is formed to correspond to the size of the hollow and the movement hole 341 in the connection rod 340.

In addition, connection spring members 346 are provided between the lower portions of the first and second bodies 110 and 130 and the lower portions of the connection rods 340. Each of the connection spring members 346 is provided with ring members 347*a* and 347*b* at one and other ends thereof, one side ring member 347*a* of the connection spring member 346 is coupled to the fixing ring 144 formed on the lower side of each of the first and second bodies 110 and 130, and the other ring member 347*b* thereof is coupled to the fixing ring 342 formed in the lower portion of the connection rod 340.

As described above, the upper portions of the first and second bodies 110 and 130 and the connection rods 340 are interconnected by the movable rods 345 and the first and second bodies 110 and 130 and the lower portions of the connection rods 340 are interconnected by connection spring members 346, so that the center of gravity of the bicycle exercise apparatus 1 may be stably distributed.

By the structure as described above, when the convertible bicycle exercise apparatus 1 according to the present invention is configured and used in a dancing form, the body part 100 is vertically moved up and down by a user's movement, the movable rods 345 connected to the coupling members 141 of the body part 100 are selectively raised and lowered in the vertical direction by the elasticity of the movable spring members 343 in response to the movement of the body part 100, and the lower portion of the body part 100 is also selectively raised and lowered in the vertical direction by the connection spring members 346.

Meanwhile, in order to convert the convertible bicycle exercise apparatus 1 according to the present invention into a riding form and then use it, pipe-shaped fixing rods 350 having a hollow therein to be detachably inserted and installed into the upper portions of the support rods 331*a* and 331*b* are further included. Each of the fixing rods 350 is provided with a slot-shaped rotation hole 351 elongated in the vertical direction on one side thereof, and a rotatable spring member 352 having elasticity in the vertical direction is provided in the hollow.

In this case, the size of the hollows of the fixing rods 350 is formed to correspond to the size of the support rods 331*a* and 331*b* so that the fixing rods 350 are detachably inserted and installed into the upper portions of the support rods 331*a* and 331*b*.

In this case, rotation covers 353 configured to be rotatable at idle are detachably installed on the tops of the fixing rods 350. The bottoms of the rotation covers 353 are connected to the upper ends of the rotatable spring members 352, and the rotatable spring members 352 are also rotated in response to the idle rotation of the rotation covers 353.

In addition, annular fixing rings 145 are provided on the respective tops of the outer surfaces of the vertical members 113 and 133 of the first and second bodies 110 and 130 of the body part 100.

Meanwhile, fixing spring members 355 are provided between the rotatable spring members 352 provided in the hollows inside the fixing rods 350 and the fixing rings 145 provided on the outer surfaces of the vertical members 113 and 133. Ring members 356 are formed on first sides of the fixing spring members 355, the ring members 356 of the fixing spring members 355 are coupled to the fixing rings 145 formed on the outer surfaces of the vertical members 113 and 133 of the first and second bodies 110 and 130, and the second sides thereof are connected to the rotatable spring members 352 by rotation members 357.

The rotation members 357 are formed as rectangular plates, and connection holes 357*a* and 357*b* are formed through first and second sides thereof. Any one 357*a* of the connection holes 357*a* and 357*b* is connected to the ring member 356 of the fixing spring member 355 coupled to the fixing ring 145 formed on the outer surface of the vertical members 113 and 133 of the first and second bodies 110 and 130, and the other connection hole 357*b* is connected to the rotatable spring member 352 provided in the hollow of the fixing rod 350.

As described above, the fixing spring members 355 and the rotatable spring members 352 are interconnected by the rotation members 357 so that, when the rotatable spring members 352 are rotated in response to the clockwise rotation of the rotation covers 353 of the fixing rods 350, the rotation members 357 are lowered while rotating along the rotatable spring members 352 formed in a spiral shape. Accordingly, the fixing spring members 355 connected to the rotation members 357 are lowered. When the rotatable spring members 352 are rotated in response to the counterclockwise rotation of the rotation covers 353 of the fixing rods 350, the rotation members 357 are raised while rotating along the rotatable spring members 352 formed in a spiral shape. Accordingly, the fixing spring members 355 connected to the rotation members 357 are raised.

In one embodiment of the present invention, in response to the clockwise rotation of the rotation covers 353, the rotation members 357 are lowered while rotating along the rotatable spring members 352, and thus the fixing spring members 355 connected to the rotation members 357 are lowered. Furthermore, in response to the counterclockwise rotation of the rotation covers 353, the rotation members 357 are raised while rotating along the rotatable spring members 352, and thus so that the fixing spring members 355 connected to the rotation members 357 are raised. In contrast, in response to the clockwise rotation of the rotation covers 353, the rotation members 357 may be raised while rotating along the rotatable spring members 352. Furthermore, in response to the counterclockwise rotations of the rotating covers 353, the rotation members 357 are lowered while rotating along the rotating spring members 352. However, the present invention is not limited thereto.

Also in this case, connection spring members (not shown) are provided between the lower portions of the first and second bodies 110 and 130 and the lower portions of the fixing rods 350, and ring members (not shown) are provided at one and other ends of the connection spring members. The one side ring members are coupled to fixing rings (the reference numeral of which is not shown) formed on the lower portions of the sides of the first and second bodies 110 and 130, and the other side ring members are coupled to fixing rings (the reference numeral of which is not shown) formed on the lower portions of the fixing rods 350.

In this way, the first and second bodies 110 and 130 and the upper portions of the fixing rods 350 are interconnected by the fixing spring members 355, and the first and second bodies 110 and 130 and the lower portions of the fixing rod 350 are interconnected by the connection spring members. Accordingly, the center of gravity of the bicycle exercise apparatus 1 may be stably distributed.

In addition, fixing members 370 are provided to be inserted and installed into the hollows formed at both ends of the first and second auxiliary support members 330*a* and 330*b*. The fixing members 370 are formed to have a size corresponding to the size of the hollows of the first and second auxiliary support members 330*a* and 330*b*, and are formed in a bar shape.

In this case, auxiliary support rods 371 are formed to protrude upward from the upper surfaces of first sides of the fixing members 370, and auxiliary fixing rods 372 are detachably inserted and installed into the upper portions of the auxiliary support rods 371.

In this case, the size of the hollows of the auxiliary fixing rod 372 are formed to correspond to the size of the auxiliary fixing rods 371 so that the auxiliary fixing rods 372 are detachably inserted into the upper portions of the auxiliary support rods 371.

In this case, auxiliary fixing rods 372 are formed in the shape of a pipe having a hollow therein, slot-shaped auxiliary rotation holes 373 formed to be elongated in the vertical direction on one side thereof are formed through the auxiliary fixing rods 372, and auxiliary rotation spring members 374 having elasticity are provided in the hollows.

In addition, auxiliary rotation covers 372*a* configured to be rotatable at idle are detachably installed at the upper ends of the auxiliary fixing rods 372. The lower portions of the auxiliary rotation covers 372*a* are connected to the upper ends of the auxiliary rotation spring members 374. The auxiliary rotation spring members 374 are also configured to be rotated in response to the idle rotation of the auxiliary rotation covers 372*a*.

Meanwhile, annular fixing rings 147 and 147' are respectively provided on both sides of the vertical members 113 and 133 of the first and second bodies 110 and 130 of the body part 100, and auxiliary fixing spring members 375 are provided between the auxiliary rotation spring members 374 provided in the hollows inside the auxiliary fixing rods 372 and the fixing rings 147 and 147' provided on both sides of the vertical members 113 and 133. The auxiliary fixing spring members 375 have ring members 376 formed on first sides thereof. The ring members of the auxiliary fixing spring members 375 are coupled to the fixing rings 147 and 147' formed on both sides of the vertical members 113 and 133 of the first and second bodies 110 and 130. The second ends thereof are respectively connected to the auxiliary rotation spring members 374 by auxiliary rotation members 377.

By the above-described structure, the upper portions of the outer surfaces of the first and second bodies 110 and 130 of the body part 100 are connected to the upper portions of the fixing rods 350 coupled to the respective support rods 331*a* and 331*b* of the first and second auxiliary support members 330*a* and 330*b* by the fixing spring members 355. Furthermore, the fixing rods 350 and the auxiliary fixing rods 372 are radially connected to the body part 100 in such a manner that the upper portions of both sides of the first and second bodies 110 and 130 of the body part 100 are connected to the upper parts of the respective auxiliary fixing rods 372 coupled to both side ends of the first and second auxiliary support members 330*a* and 330*b* by the auxiliary fixing spring members 375, and so forth. Accordingly, bicycle exercise may be performed more stably.

Also in this case, the auxiliary rotation members 377 are formed as rectangular plates, and auxiliary connection holes 378*a* and 378*b* are respectively formed through first and second sides of the auxiliary rotation members 377. Any one 378*a* of the auxiliary connection holes 378*a* and 378*b* is connected to the ring member 376 of the auxiliary fixing spring member 375 coupled to the fixing rings 147 and 147' formed on both sides of the vertical members 113 and 133 of the first and second bodies 110 and 130. The other auxiliary connection hole 378*b* is connected to the auxiliary rotation spring member 374 provided in the hollow of the auxiliary fixing rod 372.

As described above, the auxiliary fixing spring members 375 and the auxiliary rotation spring members 374 are interconnected by the auxiliary rotation members 377. Accordingly, when the auxiliary rotation spring members 374 are rotated in response to the clockwise rotation of the auxiliary rotation covers 372*a* of the auxiliary fixing rods 372 like in the case of the rotation of the rotation covers 353 of the fixing rods 350, the auxiliary rotation members 377 are lowered while rotating along the auxiliary rotating spring members 374 formed in a spiral shape. Accordingly, the auxiliary fixing spring members 375 connected to the auxiliary rotating members 377 are lowered. When the auxiliary rotation spring members 374 are rotated in response to the counterclockwise rotation of the auxiliary rotation covers 372*a* of the auxiliary fixing rods 372, the auxiliary rotation members 377 are raised while rotating along the auxiliary rotation spring members 374 formed in a spiral shape.

Accordingly, the auxiliary fixing spring members 375 connected to the auxiliary rotation members 377 are raised.

Furthermore, the upper portions of the outer surfaces of the first and second bodies 110 and 130 of the body part 100 are respectively connected to the upper portions of the fixing rods 350, coupled to the support rods 331*a* and 331*b* of the first and second auxiliary support members 330*a* and 330*b*, by the fixing spring members 355. The upper portions of both sides of the first and second bodies 110 and 130 of the body part 100 are connected to the upper portions of the auxiliary fixing rods 372, coupled to the auxiliary support rods 371 coupled to both ends of the first and second auxiliary support members 330*a* and 330*b*, by the auxiliary fixing spring members 375. Accordingly, there may be prevented a safety-related accident in which a user falls down because the bicycle exercise apparatus 1 is biased to one side by the weight of the user's weight when the user uses the bicycle exercise apparatus 1. Compared to the center of gravity of the conventional bicycle exercise apparatus, the center of gravity of the bicycle exercise apparatus 1 according to the present invention has located above the user's groin. As a result, the user's weight may be stably supported even during intense exercise.

Also in this case, connection spring members (not shown) are provided between the lower portions of both sides of the first and second bodies 110 and 130 and the lower portions of the auxiliary fixing rods 372. Ring members (not shown) are provided between first and second side ends of the connection spring members. One ring member is coupled to a fixing ring (the reference numeral of which is not shown) formed on the lower portions of both side of the first and second bodies 110 and 130, and the other ring member is coupled to a fixing ring (the reference numeral of which is not shown) formed on the lower portion of the auxiliary fixing rod 372.

Meanwhile, a plurality of fastening holes 301 is formed through both sides of the support members 310, first and second auxiliary support members 330*a* and 330*b* and fixing members 370 of the support part 300 at predetermined intervals. Fastening holes 301 are also formed through the support rods 331*a* and 331*b*, the fixing rods 350, the auxiliary support rods 371, the auxiliary fixing rods 372, and the connection rods 340. Fastening members (not shown) are selectively fastened to and separated from the fastening holes 301 so as to be selectively coupled thereto and separated therefrom.

Although the spring members are provided as elastic elements for connecting the body part 100 and the support part 300 in one embodiment of the present invention, elastic elements made of a synthetic resin material or other various materials may be provided to connect the body part 100 and the support part 300. The present invention is not limited thereto. It may be also possible that elastic elements made of various materials and having shapes that are functionally replaceable are provided interchangeably. It will be apparent that the above elements are also included in the scope of the present invention.

The saddle part 500 includes a saddle height adjustment member 510 configured to be detachably inserted and installed into an opening formed at an upper end of any one of the vertical members 113 and 133 of the body part 100; a saddle movement member 520 configured to be moved and detachably installed on the saddle height adjustment member 510; a seating member 530 formed to allow a user to be seated thereon; and a saddle connection member 540 configured to connect the saddle movement member 520 and the seating member 530.

The saddle height adjustment member 510 is detachably inserted into the opening 117*a* formed at the upper end of the vertical member 113, is formed in an inverted and reversed "L" shape, and is formed to have a size corresponding to the size of the opening 117*a* and the hollow (the reference numeral of which is not shown) formed at the upper end of the vertical member 113.

In addition, installation holes 511 are formed in both sides of the saddle height adjustment member 510 at predetermined intervals. The size and interval of the installation holes 511 are the same as the size and interval of the fastening holes 101 and 301 formed in the body part 100.

Meanwhile, the saddle movement member 520 is formed in the shape of a pipe having a movement hole 521 so that it is movably inserted and installed into the saddle height adjustment member 510. When the saddle movement member 520 is detachably inserted and installed into the saddle height adjustment member 510, it is fixed after sliding on the saddle height adjustment member 510 according to a user's physical conditions.

To this end, the size and shape of the movement hole 521 of the saddle moving member 520 are formed to correspond to the size and shape of the saddle height adjustment member 510. A coupling hole 523 is formed on both sides or either side of the saddle movement member 520. A fastening member (not shown) such as a bolt is fastened to the coupling hole 523 to fix the saddle movement member 520 on the saddle height adjustment member 510.

The seating member 530 is formed such that a user positions his or her buttocks thereon, and is formed to correspond to a general bicycle saddle. The present invention is not limited thereto.

The saddle connection member 540 is formed to extend on the top surface of the saddle movement member 520 to connect the saddle moving member 520 and the seating member 530, and is inserted and installed on the outer surface of the seating member 530.

In this case, hemispherical slots (the reference numeral of which is not shown) are respectively formed at positions corresponding to the side surface of the saddle connection member 540 and the lower side of the seating member 530. The saddle connection member 540 rotates the seating member 530. By fastening bolts (not shown) through the slots, the seating member 530 may be fixed with respect to the saddle connection member 540.

As described above, since the seating member 530 is rotated based on the saddle connecting member 540, it may be positioned and used to suit the user's physical conditions.

Meanwhile, the seating member 530 is further provided with a backrest member. The backrest member is formed in a sideways "U" shape to surround the user's body, and is rotatably provided on the side surface of the saddle connection member 540.

The handle part 600 includes a handle height adjustment member 610 configured to be detachably inserted and installed into the opening 117*a* formed at the upper end of any one of the vertical members 113 and 133 of the body part 100; a handle movement member 620 configured to be moved and detachably installed on the handle height adjustment member 610; a grip member 630 configured to be gripped by the user with both hands; and a handle connection member 640 configured to connect the handle height adjustment member 610 and the grip member 630.

The handle height adjustment member 610 is detachably inserted into the opening 137*a* formed at the upper end of the vertical member 133, and is formed in an "L" shape. The handle height adjustment member 610 is formed to have a size corresponding to the size of the opening 137*a* and the hollow (the reference numeral of which is not shown) formed at the upper end of the vertical member 133.

In addition, installation holes 611 are formed through both sides of the handle height adjustment member 610 at predetermined intervals. The size and interval of the installation holes 611 are the same as the size and interval of the fastening holes 101 and 301 formed in the body part 100.

In this case, the handle movement member 620 is formed in the shape of a pipe having the movement hole 621 so that it can be movably inserted and installed into the handle height adjustment member 610. The size and shape of the movement hole of the handle movement member 620 is formed to correspond to the size and shape of the handle height adjustment member 610.

In this case, when the handle movement member 620 is detachably inserted and installed into the handle height adjustment member 610, it is fixed after sliding on the handle height adjustment member 610 according to the user's physical conditions.

To this end, coupling holes 623 are formed on both sides or either side of the handle movement member 620, and the handle movement member 620 is fixed onto the handle height adjustment member 610 by tightening fastening members (not shown), such as bolts, into the coupling holes 623.

The grip member 630 is formed to be gripped by the user with both hands, has an approximately sideways "U" shape, and is rotatable over a predetermined angle in the vertical direction.

The handle connecting member 640 connects the handle height adjustment member 610 and the grip member 630, and is rotatably connected to the handle height adjustment member 610 in a horizontal direction. The handle height adjustment member 610 and the grip member 630 are interconnected by a coupling member (the reference numeral of which is not shown).

The pedal part 700 is intended to allow exercise to be performed while being rotated by the stepping of the user's foot when the convertible bicycle exercise apparatus 1 according to the present invention is used. The pedal part 700 is installed on any one 132 of the lower horizontal members 112 and 132 of the body part 100.

To this end, the pedal part 700 includes a pedal movement member 710 having an inverted "U"-shaped cross-section in which one side surface is opened so that a seating space (not shown) is formed therein such that the pedal movement member 710 can be movably seated and installed on the lower horizontal member 132; a pedal member 720 connected to the top surface of the pedal movement member 710 and configured to be stepped on by the user; and a driving unit (the reference numeral of which is not shown) configured to receive the rotation of the pedal member 720.

In this case, the size of the seating space formed inside the pedal movement member 710 corresponds to the size of the horizontal members 111, 131, 122, and 132 and vertical members 113 and 133 of the body part 1. Installation holes 711 having the same size and interval as the fastening holes 101 and 301 of the body part 100 and the support part 300 are formed through both sides of the pedal moving member 710 at predetermined intervals.

In this case, since the driving unit (the reference numeral of which is not shown) has the same configuration as that of a general bicycle including wheels, a chain, and sprockets, a detailed description thereof will be omitted below.

In one embodiment of the present invention, the saddle part 500 is detachably inserted and installed into the upper end of the vertical member 111 of the first body 110, and the handle part 600 is detachably inserted and installed into the upper end portion of the second body 130 in the vertical direction. The positions of the saddle part 500 and the handle part 600 are not limited thereto. The positions of the saddle part 500 and the handle part 600 may be changed according to the position of the pedal part 700. Various modifications may be possible in practice.

Meanwhile, the body part 100 further includes a footrest part 800 configured such that a user can put his or her foot thereon. The footrest part 800 includes a footrest movement member 810 configured to be movably inserted and installed into the lower horizontal members 112 and 132 of the body part 100, and a footrest member 820 connected to the footrest movement member 810 and configured to allow the user's foot to be placed thereon.

The footrest movement member 810 is formed in the shape of a pipe having movement holes so that it can be movably inserted and installed into the horizontal members 111, 131, 112, and 132 of the body part 100. The size and shape of the movement holes 811 of the footrest movement member 810 are formed to correspond to the size of the horizontal members 111, 131, 112, and 132 and vertical members 113 and 133 of the body part 100.

In addition, the installation holes 813 spaced apart from each other at regular intervals and having the same size and interval as the fastening holes 101 and 301 of the body part 100 and the support part 300 are formed through both sides of the footrest movement member 810.

Meanwhile, the footrest member 820 is formed as a plate, and is configured to allow the user to be placed thereon during exercise.

In this case, the installation holes 511 and 611 formed to be spaced apart from each other at regular intervals in the longitudinal direction on both sides of each of the height adjustment members 510 and 610 included in the saddle part 500 and the handle part 600 are preferably formed to have a size and an interval corresponding to those of the fastening holes 101 and 301 of the body part 100 and the support part 300. Furthermore, the installation holes 711 and 813 formed to be spaced apart from each other at regular intervals in the longitudinal direction on both sides of each of the movement members 710 and 810 of the pedal part 700 and the footrest part 800 are also preferably formed to have a size and an interval corresponding to those of the fastening holes 101 and 301 of the body part 100 and the support part 300. The present invention is not limited thereto. Various modifications may be possible.

For this reason, when the saddle part 500, the handle part 600, the pedal part 700, and the footrest part 800 are installed onto the body part 100, the installation holes 511, 611, 711, and 813 are aligned with the fastening holes 101 and 301, and then fastening members (not shown) such as bolts are installed through the installation holes 511, 611, 711, and 813 and the fastening holes 101 and 301, so that the saddle part 500, the handle part 600, the pedal part 700, and the footrest part 800 may be fixedly installed onto the body part 100.

In this way, the convertible bicycle exercise apparatus 1 according to the present invention is configured such that the fastening holes 101 and 301 and the installation holes 511, 611, 711, and 813 are formed in the individual component parts, the holes 101, 301, 511, 611, 711, and 813 are aligned and then the fastening members such as bolts are tightened, so that it can be converted into various forms to fit the physical conditions of each user.

According to the above-described structure, the convertible bicycle exercise apparatus 1 according to the present invention has a standing form as its basic form, and may be converted into a sitting form, a dancing form, and a riding form and then used.

Various modifications of the convertible bicycle exercise apparatus according to the present invention will be described below.

First, in the case of the standing form, as shown in FIGS. 2 to 4, the sideways "U"-shaped first body 110 of the convertible bicycle exercise apparatus 1 and the second body 130 are disposed symmetrically to each other, and then the first body 110 and the second body 130 are coupled to each other, thereby forming the body part 100.

In this case, before the first body 110 and the second body 130 are coupled to each other, the pedal part 700 and the footrest part 800 are first installed onto the lower horizontal members 112 and 132 of the second and first bodies 130 and of the body part 100.

In this case, the lower horizontal member 132 of the second body 130 is coupled to the seating space of the pedal movement member 710 of the pedal part 700, and is then moved to a position corresponding to a user's physical conditions. Furthermore, the installation holes 711 of the pedal movement member 710 and the fastening holes 101 of the lower horizontal member 132 are aligned with each other, and then fastening members (not shown) are tightened through the installation holes 711 and the fastening holes 101. Accordingly, the pedal part 700 is installed onto the second body 130.

In addition, the movement hole 811 of the footrest movement member 810 of the footrest part 800 is slidably coupled to the lower horizontal member 111 of the first body 110 and is then moved to a position corresponding to the user's physical conditions. Thereafter, the installation holes 813 of the footrest movement member 810 and the fastening holes 101 of the lower horizontal member 112 are aligned with each other. Thereafter, fastening members (not shown) are tightened through the installation holes 813 and the fastening holes 101. Accordingly, the footrest part 800 is installed onto the first body 110.

As described above, the footrest part 800 and the pedal part 700 are installed onto the first body 110 and the second body 130, the coupling piece 114 formed to protrude from the upper horizontal member 111 of the first body 110 is inserted and installed into the hollow (the reference numeral of which is not shown) formed in the upper horizontal member 131 of the second body 130, and then the coupling piece 134 formed to protrude from the lower horizontal member 132 of the second body 130 is inserted and installed into the hollow formed in the lower horizontal member 112 of the first body 110, thereby forming the body part 100.

In this case, the insertion positions of the coupling piece 114 formed to protrude from the upper horizontal member 111 of the first body 110 and the coupling piece 134 formed to protrude from the lower horizontal member 132 of the second body 130 are adjusted in the hollow to fit the user's physical conditions. Thereafter, the fastening holes 101 of the first and second bodies 110 and 130 and the fastening holes 101 of the coupling pieces are aligned with each other. Thereafter, fastening members such as bolts are installed. Accordingly, the coupling of the body part 100 may be completed.

Furthermore, the position of the pedal part 700 may be adjusted to fit the user's physical conditions. In other words, the position of the pedal unit 700 may be adjusted to fit the height of the user by positioning the pedal part 700 close to or away from the saddle part 500 in such a manner that the pedal part 700 installed on the lower horizontal member 132 of the second body 130 is moved toward the lower horizontal member 112 of the first body 110 and then installed when the user is short, the pedal part 700 installed on the lower horizontal member 132 of the second body 130 is moved toward the vertical member 133 of the second body 130 and then installed when the user is tall, and so forth.

Thereafter, the saddle part 500 is inserted and installed into the hollow through the opening 117*a* formed through the upper end of the vertical member 113 of the first body 110, and the handle part 600 is inserted and installed into the hollow through the opening 137*a* formed through the upper end of the vertical member 133 of the second body 130.

In other words, the saddle height adjustment member 510 is inserted and installed into the hollow through the opening 117*a* formed through the upper end of the vertical member 113 of the first body 110, the saddle movement member 520 is inserted and installed into the saddle height adjustment member 510, and the saddle height adjustment member 510 is inserted into the movement hole 521 of the saddle movement member 520, thereby installing the saddle part 500 onto the first body 110. The handle height adjustment member 610 is inserted and installed into the hollow through the opening 137*a* formed through the upper end of the vertical member 133 of the second body 130, the handle movement member 620 is inserted and installed into the handle height adjustment member 610, and the handle height adjustment member 610 is inserted and installed into the movement hole 621 of the handle movement member 620, thereby installing the handle part 600 onto the second body 130.

In this case, the height of the saddle height adjustment member 510 inserted and installed into the vertical member 113 of the first body 110 is adjusted to fit the user's physical conditions, the installation holes 511 of the saddle height adjustment member 510 and the fastening holes 101 of the vertical member 113 are aligned with each other, and then fastening members are tightened, thereby fixedly installing the saddle height adjustment member 510 onto the first body 110. Furthermore, the height of the handle height adjustment member 610 inserted and installed into the vertical member 133 of the second body 130 is adjusted to fit the user's physical conditions, the installation holes 611 of the handle height adjustment member 610 and the fastening holes 101 of the vertical member 133 are aligned with each other, and fastening members are tightened, thereby fixedly installing the handle height adjustment member 610 onto the second body 130.

In addition, the saddle movement member 520 movably inserted and coupled into the saddle height adjustment member 510 is moved to fit the user's physical conditions, the coupling holes 523 of the saddle movement member 520 and the installation holes 511 of the saddle height adjustment member 510 are aligned with each other, and then fastening members are tightened, thereby fixedly installing the saddle movement member 520 onto the saddle height adjustment member 510. Furthermore, the handle movement member 620 movably inserted and coupled into the handle height adjustment member 610 is moved to fit the user's physical conditions, the coupling holes 623 of the handle movement member 620 and the installation holes 611 of the handle height adjustment member 610 are aligned with each other, and then fastening members are tightened, thereby fixedly installing the handle movement member 620 onto the handle height adjustment member 610.

Furthermore, the seating member 530 connected to the saddle connection member 540 of the saddle part 500 may be adjusted to fit the user's physical conditions through rotation, and the grip member 630 of the handle part 600 gripped by the user may be adjusted to fit the user's physical conditions through rotation.

In this case, the end of the saddle height adjustment member 510 of the saddle part 500 is disposed in the direction of the second body 130 so that the saddle part 500 is placed on the upper horizontal member 111 of the first body 110, and the end of the handle height adjustment member 610 of the handle part 600 is disposed in the direction of the first body 110 so that the handle part 600 is placed on the upper horizontal member 131 of the second body 130.

In this way, the support part 300 is installed into the body part 100 to which the first body 110 and the second body 130 are coupled.

In other words, the auxiliary coupling pieces 333*b* of the first auxiliary support member 330*a* and the second auxiliary support member 330*b* are inserted and installed into the hollows in both ends of the support member 310 of the support part 300, and then the support rods 331*a* and 331*b* formed to protrude upward from the centers of the first and second auxiliary support members 330*a* and 330*b* are inserted and installed into the openings 117*b* and 137*b* formed through the lower ends of the vertical members 113 and 133 of the first and second bodies 110 and 130, thereby installing the support part 300 onto the body part 100.

In this case, when the auxiliary coupling pieces 333*b* of the first and second auxiliary support members 330*a* and 330*b* are inserted into both ends of the support member 310, the first and second auxiliary support members 330*a* and 330*b* are disposed symmetrically to each other, and the auxiliary coupling pieces 333*b* are inserted into the hollows in both ends of the support member 310.

In this case, when the auxiliary support members 330*a* and 330*b* are inserted into the hollows so that the side surfaces of the first auxiliary support member 330*a* and the second auxiliary support member 330*b* may abut against both ends of the support member 310, the support rods 331*a* and 331*b* formed to protrude upward from the first and second auxiliary support members 330*a* and 330*b* are accordingly positioned in the hollows and the openings 117*b* and 137*b* formed through the lower ends of the vertical members 113 and 133 of the first and second bodies 110 and 130.

As described above, the auxiliary coupling pieces 333*b* of the first and second auxiliary support members 330*a* and 330*b* are inserted into the hollows formed through both ends of the support member 310 and then fastening members are tightened, and the support rods 333*a* and 333*b* of the first and second auxiliary support members 330*a* and 330*b* are inserted and installed into the vertical members 113 and 133 of the first and second bodies 110 and 130 and then fastening members are tightened, thereby installing the support part 300 onto the body part 100.

Even in this case, the height of the body part 100 installed on the support part 300 is positioned to fit the user's physical conditions, and then fastening are performed through fastening members, thereby installing the body part 100 on the support part 300.

In this way, the support part 300 is coupled and installed onto the body part 100, so that the shaking attributable to the user's movement is supported through the support member 310 and the first and second auxiliary support members 330*a* and 330*b* supporting both sides of the support member 310.

As described above, the pedal part 700, the footrest part 800, the saddle part 500, the handle part 600, and the support part 300 are sequentially coupled and installed to the body part 100, and thus the convertible bicycle exercise apparatus 1 according to the present invention may be fabricated in a standing form.

Although an example the pedal part 700, the footrest part 800, the saddle part 500, the handle part 600, and the support part 300 are sequentially combined with and installed onto the body part 100 in order to fabricate the convertible bicycle exercise apparatus 1 in a standing form is described in one embodiment of the present invention, the above-described sequence may be changed for the convenience of the user, and is not limited thereto.

In this way, when exercise is done through the convertible bicycle exercise apparatus 1 according to the present invention that is converted into a standing form, the user's buttocks are positioned on the seating member 530 of the saddle part 500, and both hands of the user grip the grip member 630 of the handle part 600. In this case, the user takes a posture in a standing form, such as the posture of taking the motion of bending his or her back at a specific angle in order to grip the handle part 600 with both hands, the user's feet step on the pedal member 720 of the pedal unit 700, and pedaling is repeated, thereby doing bicycle exercise.

Meanwhile, in the case of a sitting form, as shown in FIG. 5, the sitting form may be obtained by modifying only part of the above-described standing form.

In other words, before the first body 110 and the second body 130 are coupled to each other to form the body part 100, the footrest part 800 and the pedal part 700 are first installed onto the first body 110 and the second body 130, and the pedal part 700 is installing onto the vertical member 133 of the second body 130. In this case, the pedal part 700 is installed to be located outside the vertical member 133 of the second body 130.

Even in this case, the position of the pedal part 700 may be adjusted to fit a user's physical conditions. In other words, the position of the pedal unit 700 may be adjusted to fit the height of the user by positioning the pedal part 700 close to or away from the handle part 600 in such a manner that the pedal part 700 installed on the lower horizontal member 132 of the second body 130 is moved toward the upper horizontal member 131 and then installed when the user is short, the pedal part 700 installed on the lower horizontal member 132 of the second body 130 is moved toward the lower horizontal member 132 and then installed when the user is tall, and so forth.

In this way, the footrest part 800 and the pedal part 700 are installed on the lower horizontal member 112 of the first body 110 and the vertical member 133 of the second body 130. Thereafter, the coupling piece 114 formed to protrude from the upper horizontal member 111 of the first body 110 is inserted and installed into the hollow formed in the upper horizontal member 131 of the second body 130, and the coupling piece 134 formed to protrude from the lower horizontal member 132 of the second body 130 is inserted and installed into the hollow formed in the lower horizontal member 112 of the first body 110. Accordingly, the body part 100 is formed.

Thereafter, the saddle part 500 is inserted and installed into the hollow through the opening 117*a* formed at the upper end of the vertical member 113 of the first body 110, and the handle part 600 is inserted and installed into the hollow through the opening 137*a* formed at the upper end of the vertical member 133 of the second body 130. The ends of the saddle height adjustment member 510 of the saddle part 500 and the handle height adjustment member 610 of the handle part 600 are disposed to be directed to the outside of the first body 110 and the second body 130. The seating member 530 is installed into the saddle height adjustment member 510 by inserting and fastening the saddle movement member 520 to the saddle height adjustment member 510. The grip member 630 is installed onto the handle height adjustment member 610 by inserting and fastening the handle movement member 620 into the handle height adjustment member 610.

As described above, the saddle height adjustment member 510 and handle height adjustment member 610 of the saddle part 500 and the handle part 600 installed at the upper ends of the vertical members 113 and 133 of the first and second bodies 110 and 130 are installed such that the ends thereof are directed to the outside of the first and second bodies 110 and 130. Accordingly, the gap between the seating member 530 and the grip member 630 inserted and installed into the saddle height adjustment member 510 and the handle height adjustment member 610 may be increased compared to that of the standing form. As a result, the user may utilize the bicycle exercise apparatus 1 in a sitting form.

In addition, the saddle part 500 and the handle part 600 are installed on the body part 100 and then the support part 300 is installed, so that the convertible bicycle exercise apparatus 1 according to the present invention is converted into a sitting form.

In this way, in the case of the sitting form, the position of the pedal part 700 is changed into the position for the standing form, the distance between the saddle part 500 and the handle part 600 is increased compared to that of the standing form by changing the positions of the saddle part 500 and the handle part 600, the user takes a posture for the sitting form, and then bicycle exercise is done.

Meanwhile, in the case of a dancing form, as shown in FIGS. 6 and 7, the dancing form is a modified example in which part of the basic standing form is modified.

In other words, in the dancing form of the convertible bicycle exercise apparatus 1 according to the present embodiment, the footrest part 800 and the pedal part 700 are installed on the lower horizontal members 132 of the first and second bodies 110 and 130, the coupling pieces 114 and 134 of the first and second bodies 110 and 130 are inserted and coupled into the hollows of the second body 130 and the first body 110 to form the body part 100, the saddle part 500 is installed on the vertical member 113 of the first body 110, the handle part 600 is installed on the vertical member 133 of the second body 130, the saddle height adjustment member 510 of the saddle part 500 is inserted and installed into the opening 117*a* of the vertical member 133 to be directed to the second body 130 and to be located on the upper horizontal member 111 of the first body 110, the handle height adjustment member 610 of the handle part 600 is inserted and installed into the opening 137*a* of the vertical member 133 to be directed to the first body 110 and to be located on the upper horizontal member 131 of the second body 130, and the footrest part 800, the pedal part 700, the saddle part 500, and the handle part 600 are installed on the body part 100.

Thereafter, the support part 300 is installed onto the body part 100.

In this case, the overall length of the support part 300 is extended by drawing the first and second auxiliary support members 330*a* and 330*b*, inserted and installed into both ends of the support member 310 of the support part 300, out from the support member 310 to the outside of the support part 300 to a predetermined extent. The distance between the support rods 331*a* and 331*b* formed to protrude upward from the centers of the first and second auxiliary support members 330*a* and 330*b* and the vertical members 113 and 133 of the first and second bodies 110 and 130 is increased by a predetermined distance.

As described above, when the auxiliary coupling pieces 333*a* and 333*b* of the first and second auxiliary support members 330*a* and 330*b* are drawn out from both ends of the support member 310 to the outside, the support rods 331*a* and 331*b* formed to protrude upward from the centers of the first and second auxiliary support members 330*a* and 330*b* are not inserted and installed into the hollows through the openings 117*b* and 137*b* in the lower ends of the vertical members 113 and 133 of the first and second bodies 110 and 130, and the lower horizontal members 112 and 132 of the first and second bodies 110 and 130 and the support member 310 are installed to be spaced apart from each other by a predetermined distance.

In this case, the connection rods 340 are respectively inserted and installed into the support rods 331*a* and 331*b* formed to protrude from the centers of the first and second auxiliary support members 330*a* and 330*b* drawn out from both ends of the support member 310, the movable rods 345 are installed between the coupling groove 142 of the coupling member 141 formed on the upper portions of the outer surfaces of the vertical members 113 and 133 of the first and second bodies 110 and 130 and the movement holes formed in the connection rods 340, the movable spring members 343 are installed between the fixing rings 144 formed in the lower portions of the coupling members 141 of the first and second bodies 110 and 130 and the fixing rings 342 formed in the lower portions of the movement holes 341 of the connection rods 340, and the body part 100 is installed to be spaced apart from the support part 300 by a predetermined interval in the vertical direction.

As described above, when the convertible bicycle exercise apparatus 1 according to the present invention is converted into a dancing form and then used, the body part 100 is moved selectively up and down in the vertical direction by a user's movement, the movable rods 345 connected to the coupling members 141 of the body part 100 are selectively raised and lowered in the vertical direction by the elasticity of the movable spring members 343 in response to the movement of the body part 100, and the lower portion of the body part 100 is also selectively raised and lowered in the vertical direction by the connection spring members 346.

As described above, the upper and lower portions of the outer surfaces of the first and second bodies 110 and 130 of the body part 100 are connected to the support unit 300 with the movable rods 345 and the movable spring members 343, so that the center of gravity of the bicycle exercise apparatus 1 may be stably distributed. After riding on the bicycle exercise apparatus 1 in a standing form, the user may utilize the convertible bicycle exercise apparatus 1 according to the present invention in a dancing form while selectively raising and lowering the body part 100, provided with the saddle part 500, vertically up and down.

Meanwhile, in the case of a riding form, as shown in FIGS. 8 to 10, the riding form is a modified example in which part of a dancing form is modified based on a standing form.

In this embodiment, the bicycle exercise apparatus 1 is converted into a dancing form based on a standing form. The footrest part 800 and the pedal part 700 are installed onto the body part 100 and then the first body 110 and the second body 130 are combined into the body part 100, the saddle part 500 and the pedal part 700 are installed onto the vertical members 113 and 133 of the first and second bodies 110 and 130 of the body part 100 and then the support part 300 is installed, the fixing rods 350 are installed onto the respective support rods 331*a* and 331*b* formed to protrude from the centers of the first and second auxiliary support members 330*a* and 330*b* inserted into both ends of the support member of the support part 300, and the fixing members 370 are respectively inserted and installed onto both ends of the first and second auxiliary support members 330*a* and 330*b* partially drawn out from both ends of the support member 310.

Also in this case, the support rods 331*a* and 331*b* formed to protrude upward from the centers of the first and second auxiliary supporting members 330*a* and 330*b* by drawing out the auxiliary coupling pieces 333*a* and 333*b* of the first and second auxiliary supporting members 330*a* and 330*b* from both ends of the support member 310 to the outside are not inserted and installed into the internal hollows through the openings 117*b* and 137*b* in the lower ends of the vertical members 113 and 133 of the first and second bodies 110 and 130.

As described above, the fixing rods 350, not the connection rods 340, are installed onto the tops of the support rods 331*a* and 331*b* formed to protrude upward from the centers of the first and second auxiliary support members 330*a* and 330*b*, the fixing rings 145 formed on the upper portions of the outer surfaces of the vertical members 113 and 133 of the first and second bodies 110 and 130 and the rotatable spring members 352 provided in the hollows of the fixing rods 350 are interconnected with the fixing spring members 355, and the fixing spring members 355 and the rotatable spring members 352 are interconnected through the rotation members 357.

In addition, the fixing rings 145 formed on the outer surfaces of the first and second bodies 110 and 130 and the rotatable spring members 352 provided in a vertical direction in the hollows of the fixing rods 350 and configured to be rotated by the rotation of the rotation covers 353 made to rotate idle at the upper ends of the fixing rods 350 possible are connected to the fixing spring members 355 by the rotation members 357.

In this way, the fixing spring members 355 are connected to the rotatable spring members 352 by the rotation members 357. Accordingly, when the rotation covers 353 are rotated clockwise or counterclockwise, the rotation members 357 connected to the rotatable spring members 352 are lowered or raised vertically. The height is adjusted to fit a user's physical conditions while selectively raising and lowering the body part 100 up and down based on the support part 300.

In addition, the auxiliary fixing rods 372 are inserted and installed into the auxiliary support rods 371 formed to protrude upward from the upper surfaces of first edges of the fixing members 370 inserted and installed at both ends of the first and second auxiliary support members 330*a* and 330*b*. The fixing rings 147 and 147' formed on both sides of the first and second bodies 110 and 130 and the auxiliary rotation spring members 374 vertically provided in the hollows of the auxiliary fixing rods 372 and configured to be rotated by the rotation of the auxiliary rotation covers 372*a* made to be rotatable at idle at the upper ends of the auxiliary fixing rods 372 are connected to the auxiliary fixing spring members 375 by the auxiliary rotation members 377.

In this way, the auxiliary fixing spring members 375 are connected to the auxiliary rotation spring members 374 by the auxiliary rotation members 377. Accordingly, when the auxiliary rotation covers 372*a* are rotated clockwise or counterclockwise, the auxiliary rotation covers 372*a* connected to the auxiliary rotation spring members 374 are lowered or raised in the vertical direction. The height is adjusted to fit the user's physical conditions while selectively raising and lowering the body part 100 up and down based on the support part 300.

As described above, in the convertible bicycle exercise apparatus 1 according to the present invention, the upper portions of the outer surfaces of the first and second bodies 110 and 130 of the body part 100 are coupled to the upper portions of the fixing rods 350 coupled to the respective support rods 331*a* and 331*b* of the first and second auxiliary support members 330*a* and 330*b* by the fixing spring members 355 to be movable in the vertical direction. Furthermore, the upper portions of both sides of the first and second bodies 110 and 130 of the body part 100 are connected to the upper portions of the auxiliary fixing spring members 372 coupled to both ends of the first and second auxiliary support members 330*a* and 330*b* by the auxiliary fixing spring members 375 to be movable in the vertical direction.

Furthermore, the lower portions of the first and second bodies 110 and 130 and the lower portions of the fixing rods 350 are connected by the connection spring members (not shown), and the lower portions of both sides of the first and second bodies 110 and 130 and the lower portions of the auxiliary fixing rods 372 are also connected by the connection spring members (not shown). Accordingly, they are radially connected to the fixing rods 350 and the auxiliary fixing rods 372 based on the body part 100. As a result, stable bicycle exercise is allowed by supporting the bicycle exercise apparatus 1 more stably.

Furthermore, in the case of the conventional bicycle exercise apparatus, the center of gravity thereof is located at the lower location of the bicycle exercise apparatus, so that a user's weight is moved to one side during exercise, and thus there is a risk of falling. In contrast, in the bicycle exercise apparatus 1 according to the present invention, the upper portions of the first and second bodies 110 and 130 of the body part 100 are connected to the support part 300 by the fixing rods 350 and the auxiliary fixing rods 372. Accordingly, as shown in FIG. 11, the center of gravity of the bicycle exercise apparatus 1 may be located in the upper center where the user's groin is located. The weight of the upper and lower body may be positioned such that the weight is distributed to the left and right. The bicycle exercise apparatus 1 is stable, may protect a user from the risk of falling in advance, and may be used stably. At the same time, after the user rides on the bicycle exercise apparatus 1 in the standing form, the body part 100 provided with the saddle part 500 is selectively raised up and lowered down in the vertical direction and is also bent in all the horizontal directions, e.g., in the forward, rearward, leftward and rightward direction, so that movement is free and thus various movement effects may be obtained.

In addition, holes having the same size are formed in the individual component parts of the convertible bicycle exercise apparatus 1 according to the present invention at the same intervals, the individual component parts have hollows, and the individual component parts are inserted into other component parts. After the individual component parts are positioned and arranged to fit the user's physical conditions, the holes of the individual component parts are aligned with each other, and then fastening members are fastened to enable installation and separation. As shown in FIG. 12, the convertible bicycle exercise apparatus 1 may be freely converted into various forms such as a standing form, a sitting form, a dancing form, and a riding form. Through this, effects may be achieved in that various types of exercise can be enjoyed and various types of exercise apparatuses 1 can be replaced with the single exercise apparatus 1.

While the present invention has been shown and described in conjunction with the specific embodiments, it will be readily apparent to those of ordinary skill in the art that various modifications and alterations are possible without departing from the spirit and scope of the invention set forth in the appended claims.

What is claimed is:

1. A convertible bicycle exercise apparatus, comprising:

a body part formed as pipe-shaped frames each having a hollow therein, and including a pair of a first body and a second body each of which is formed as a pipe-shaped frame, each of which includes an upper horizontal member formed in a horizontal direction, a lower horizontal member formed to be spaced apart from the upper horizontal member by a predetermined distance in a vertical direction, and a vertical member formed in a vertical direction to connect one end of the upper horizontal member and one end of the lower horizontal member, each of which is formed in a sideways "U" shape, and in each of which a plurality of fastening holes are formed through both sides thereof at predetermined intervals, wherein the second body is disposed symmetrically to the first body;

a support part configured to be provided under the body part and support the body part, formed as pipe-shaped frames each having a hollow therein, and including a support member which is formed in a bar shape, first and second auxiliary support members which are symmetrically inserted and installed into both ends of the support member, and each of which is formed in a "T" shape in which an auxiliary coupling piece is formed to protrude from a center thereof, and support rods which are formed to protrude upward at respective centers of the first and second auxiliary support members, wherein a plurality of fastening holes is formed through both sides of the support part at predetermined intervals;

a saddle part including a saddle height adjustment member which is installed into any one of the vertical members of the body part and adjusts a height of the saddle part, a saddle movement member which has a pipe shape having movement holes so as to be movably installed in the saddle height adjustment member and in which installation holes are formed in both sides thereof, a seating member which is formed to allow a user to be seated thereon, and a saddle connection member which connects the saddle movement member and the seating member to each other;

a handle part including a handle height adjustment member which is installed into any one of the vertical members of the body part and adjusts a height of the saddle part, a handle movement member which has a pipe shape having movement holes so as to be movably installed in the handle height adjustment member and in which installation holes are formed in both sides thereof, a grip member which is formed to allow a user to be seated thereon, and a handle connection member which connects the handle movement member and the grip member to each other; and a pedal part including a pedal movement member which is detachably installed onto the horizontal vertical member of the body part, in which a seating space is formed therein, and in which a plurality of installation holes is formed through both sides of the pedal movement member at predetermined intervals, a pedal member which is connected to a top surface of the pedal movement member and which is rotated by being stepped on by the user, and a driving unit;

wherein a size of the fastening holes formed in the body part and the support part corresponds to a size of the installation holes formed in the saddle part, the handle part, the saddle movement member, the handle movement member, and the pedal movement member of the pedal part, an interval of the fastening holes formed in the body part and the support part corresponds to an interval of the installation holes formed in the pedal movement member of the pedal part, and the installation holes and the fastening holes are aligned with each other and fastening is performed by tightening fastening members thereinto.

2. The convertible bicycle exercise apparatus of claim 1, wherein a coupling piece is formed to protrude from an end of any one of the upper and lower horizontal members of the first body of the body part, a coupling piece is formed to protrude from an end of a remaining one of the lower and upper horizontal members of the second body, the coupling piece formed to protrude from the upper horizontal member or lower horizontal member of the first body is detachably inserted and coupled into the hollow of the upper horizontal member or lower horizontal member of the second body, and the coupling piece formed to protrude from the lower horizontal member or upper horizontal member of the second body is detachably inserted and coupled into the hollow of the lower horizontal member or upper horizontal member of the first body.

3. The convertible bicycle exercise apparatus of claim 1, wherein the support rods formed to protrude at the centers of the first and second auxiliary support members that are inserted into both ends of the support member of the support part are detachably inserted and installed into the hollows through openings formed at lower ends of the respective vertical members formed in a direction vertical to the first and second bodies of the body part.

4. The convertible bicycle exercise apparatus of claim 1, wherein the saddle height adjustment member of the saddle part or the handle height adjustment member of the handle part is detachably inserted and installed into the hollow through an opening formed at an upper end of each vertical member formed in a direction vertical to the first and second bodies of the body part.

5. The convertible bicycle exercise apparatus of claim 1, wherein:

connection rods are detachably inserted and installed onto upper portions of the support rods formed to protrude from top surfaces of the centers of the first and second auxiliary coupling members, each of the connection rods is formed as a pipe shape having a hollow therein, a slot-shaped movement hole is formed in an upper portion of one side of the connection rod, a fixing ring is provided in a lower portion of the connection rod, a movable spring member having elasticity in a vertical direction is provided inside the hollow of the connection rod, a coupling member having a coupling groove is provided to protrude on each of upper portions of outer surfaces of the vertical members of the first and second bodies of the body part, and a fixing ring is provided on a lower portion of the vertical member;

movable rods are provided between the first and second bodies and the connection rods, one side of each of the movable rods is detachably inserted and coupled into the coupling groove of the coupling member formed on an upper portion of an outer surface of each vertical member, a remaining side of the movable rod is inserted and installed into the hollow through the movement hole formed in the upper portion of the connection rod and is connected to an upper end of the movable spring member, connection spring members each having ring members formed at one and other ends thereof are provided between the first and second bodies and the connection rods, one side ring member of the connection spring members is coupled to the fixing ring formed on a lower portion of an outer surface of each vertical member, and a remaining ring member thereof is coupled to the fixing ring provided on a lower portion of each of the connection rods; and when the body part is selectively raised and lowered vertically, the movable rods connected to the coupling members of the body part are selectively raised and lowered vertically by the elasticity of the movable spring members in response to movement of the body part.

6. The convertible bicycle exercise apparatus of claim 1, wherein:

fixing rods are detachably inserted and installed onto upper portions of the support rods formed to protrude from top surfaces of the centers of the first and second auxiliary coupling members;

the fixing rods are formed in a shape of a pipe having a hollow therein, a slot-shaped rotation hole is formed on one side of each of the fixing rods in a vertical direction, rotatable spring members having elasticity in vertical directions are provided inside the hollows, rotation covers are detachably installed onto upper portions of the fixing rods so as to be rotated at idle, lower portions of the rotation covers are connected to the rotation spring members, and fixing rings are provided on upper portions of outer surfaces of the vertical members of the first and second bodies of the body part;

fixing spring members having ring members formed on one and other ends thereof are provided between the first and second bodies and the fixing rods, the fixing spring members are connected to fixing rings having one side ring members formed on upper portions of outer surfaces of the vertical members, remaining side ring members are connected to the rotation spring members by rotation members, the rotation members have connection holes formed through one and other sides thereof, and any one of the connection holes is connected to one of the ring members of the fixing spring members, and a remaining connection hole is connected to one of the rotation spring members; and the rotation members connected to the fixing spring members are selectively raised and lowered up and down along the rotation spring members formed in a spiral shape in response to rotation of the rotation spring members by the rotation of the rotation covers.

7. The convertible bicycle exercise apparatus of claim 6, wherein:

fixing members are detachably inserted and installed into both ends of the first and second auxiliary support members, respectively, auxiliary support rods are formed to protrude upward from upper surfaces of first sides of the fixing members, and auxiliary fixing rods are detachably inserted and installed onto upper portions of the auxiliary support rods;

the auxiliary fixing rods are formed in a shape of a pipe having a hollow therein, slot-shaped auxiliary rotation holes are formed through first sides of the auxiliary rods in vertical directions, auxiliary rotation spring members having elasticity in the vertical directions are provided in the inner hollows, auxiliary rotation covers are detachably installed onto tops of the auxiliary fixing rods so as to be rotated at idle, bottoms of the auxiliary rotation covers are connected to the auxiliary rotation spring members, and fixing rings are provided on upper portions of both sides of vertical members of the first and second bodies of the body part;

auxiliary fixing spring members in each of which ring members are formed at one and other ends thereof are provided between the first and second bodies and the auxiliary fixing rods, the auxiliary fixing spring members are connected to the fixing rings in each of which one side ring members are formed on both sides of upper portions of the vertical members, other side ring members are connected to the auxiliary rotation spring members of auxiliary fixing holes by auxiliary rotation members, the auxiliary rotation members are provided with auxiliary connection holes formed through one and other sides thereof, any one of the auxiliary connection holes is connected to one of the ring members of the auxiliary fixing spring members, and a remaining auxiliary connection hole is connected to one of the auxiliary rotation spring members; and the auxiliary rotation members connected to the auxiliary fixing spring members are selectively raised and lowered up and down along the auxiliary rotation spring members formed in a spiral shape in response to rotation of the auxiliary rotation spring members by the rotation of the auxiliary rotation covers.

8. The convertible bicycle exercise apparatus of claim 1, wherein:

the body part further includes a footrest part; and the footrest part is formed in a shape of a pipe having a movement hole so as to be movably inserted and installed into the first and second bodies, and includes a footrest movement member configured such that a plurality of installation holes is formed through both side surfaces thereof at predetermined intervals, and a footrest member connected to the footrest movement member and formed as a plate so that feet of the user are located thereon.

* * * * *